US011365501B2

(12) United States Patent
Somyos et al.

(10) Patent No.: US 11,365,501 B2
(45) Date of Patent: Jun. 21, 2022

(54) WASHING MACHINE

(71) Applicant: Toshiba Lifestyle Products & Services Corporation, Kawasaki (JP)

(72) Inventors: Pinda Somyos, Pathumthani (TH); Pallasiri Rattarong, Pathumthani (TH); Ketsuwan Chakkaphop, Pathumthani (TH); Jitaree Paweethida, Pathumthani (TH)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 303 days.

(21) Appl. No.: 16/439,424

(22) Filed: Jun. 12, 2019

(65) Prior Publication Data

US 2019/0292708 A1 Sep. 26, 2019

Related U.S. Application Data

(63) Continuation of application No. PCT/JP2017/020653, filed on Jun. 2, 2017.

(30) Foreign Application Priority Data

Dec. 13, 2016 (JP) ..... JP2016-241194
Dec. 13, 2016 (JP) ..... JP2016-241196

(51) Int. Cl.

| | |
|---|---|
| ***D06F 13/02*** | (2006.01) |
| ***D06F 17/08*** | (2006.01) |
| ***D06F 17/10*** | (2006.01) |
| ***D06F 23/04*** | (2006.01) |
| ***D06F 37/06*** | (2006.01) |
| ***D06F 37/14*** | (2006.01) |
| ***D06F 37/40*** | (2006.01) |

(52) U.S. Cl.

CPC ..... *D06F 37/145* (2013.01); *D06F 13/02* (2013.01); *D06F 17/08* (2013.01); *D06F 17/10* (2013.01); *D06F 23/04* (2013.01); *D06F 37/06* (2013.01); *D06F 37/14* (2013.01); *D06F 37/40* (2013.01)

(58) Field of Classification Search

None

See application file for complete search history.

(56) References Cited

U.S. PATENT DOCUMENTS

2012/0180532 A1 7/2012 Park et al.

FOREIGN PATENT DOCUMENTS

| | | |
|---|---|---|
| CN | 102587070 A | 7/2012 |
| JP | 24-1674 | 5/1949 |
| JP | 4-215795 A | 8/1992 |

(Continued)

OTHER PUBLICATIONS

Kim, "KR20130037427A English machine translation.pdf", Apr. 16, 2013—Machine translation from Espacenet.com.*

(Continued)

*Primary Examiner* — Levon J Shahinian

(74) *Attorney, Agent, or Firm* — Oblon, McClelland, Maier & Neustadt, L.L.P.

(57) ABSTRACT

A washing machine of an embodiment includes: a washing tub in which laundry is housed and washed; and a roller rotatably provided in an inner wall portion of the washing tub, and the roller being rotated to facilitate movement of laundry, wherein the roller is detachably attached to the washing tub.

13 Claims, 29 Drawing Sheets

(56) References Cited

FOREIGN PATENT DOCUMENTS

| | | | |
|---|---|---|---|
| JP | 10-57673 | A | 3/1998 |
| JP | 10-118382 | | 5/1998 |
| KR | 10-2013-0037427 | | 4/2013 |

OTHER PUBLICATIONS

Combined Chinese Office Action and Search Report dated Sep. 28, 2020 in Patent Application No. 201780076703.4, 7 pages.
Japanese Office Action dated Oct. 13, 2020 in Japanese Patent Application No. 2016-241194, 3 pages.
International Search Report dated Aug. 8, 2017 in PCT/JP2017/020653 filed Jun. 2, 2017 (with English Translation).
German Office Action dated Dec. 15, 2020 in German Patent Application No. 11 2017 006 241.1 (with English translation), 7 pages.

* cited by examiner

WASHING MACHINE

CROSS-REFERENCE TO RELATED APPLICATION

This application is based upon and claims the benefit of priority from Japanese Patent Application No. 2016-241196, filed on Dec. 13, 2016, the entire contents of which are incorporated herein by reference.

TECHNICAL FIELD

Embodiments of the present invention relate to a washing machine.

BACKGROUND ART

In a washing machine of a so-called vertical axis type, it has been considered to provide a roller rotatably in a top face portion of a pulsator provided at the bottom of a washing tub (for example, see Patent Literature 1). In this case, two or three rollers are provided so as to radially extend on the pulsator. These rollers can improve movement of laundry (so-called swirling) on the pulsator.

CITATION LIST

Patent Literature

Patent Literature 1: US Patent Application Publication No. 2012/0180532

SUMMARY OF INVENTION

When a roller is provided on a pulsator as described above, a user cannot easily detach the roller from the pulsator and clean the roller. Therefore, there is a problem that contamination is liable to adhere to a portion near an attachment section of the roller. When the roller is formed in a hollow shape, there is a problem that washing water is stored in the roller. Further, there is a problem that the roller draws a cloth of laundry therein and catches the cloth.

A washing machine in which cloth swirling can be improved by providing a roller in a washing tub, and cleanability can be improved is provided.

A washing machine according to the present embodiment includes: a washing tub in which laundry is housed and washed; and a roller rotatably provided in an inner wall portion of the washing tub, the roller being rotated to facilitate movement of laundry, wherein the roller is detachably attached to the washing tub.

DESCRIPTION OF EMBODIMENTS

Figure 1:
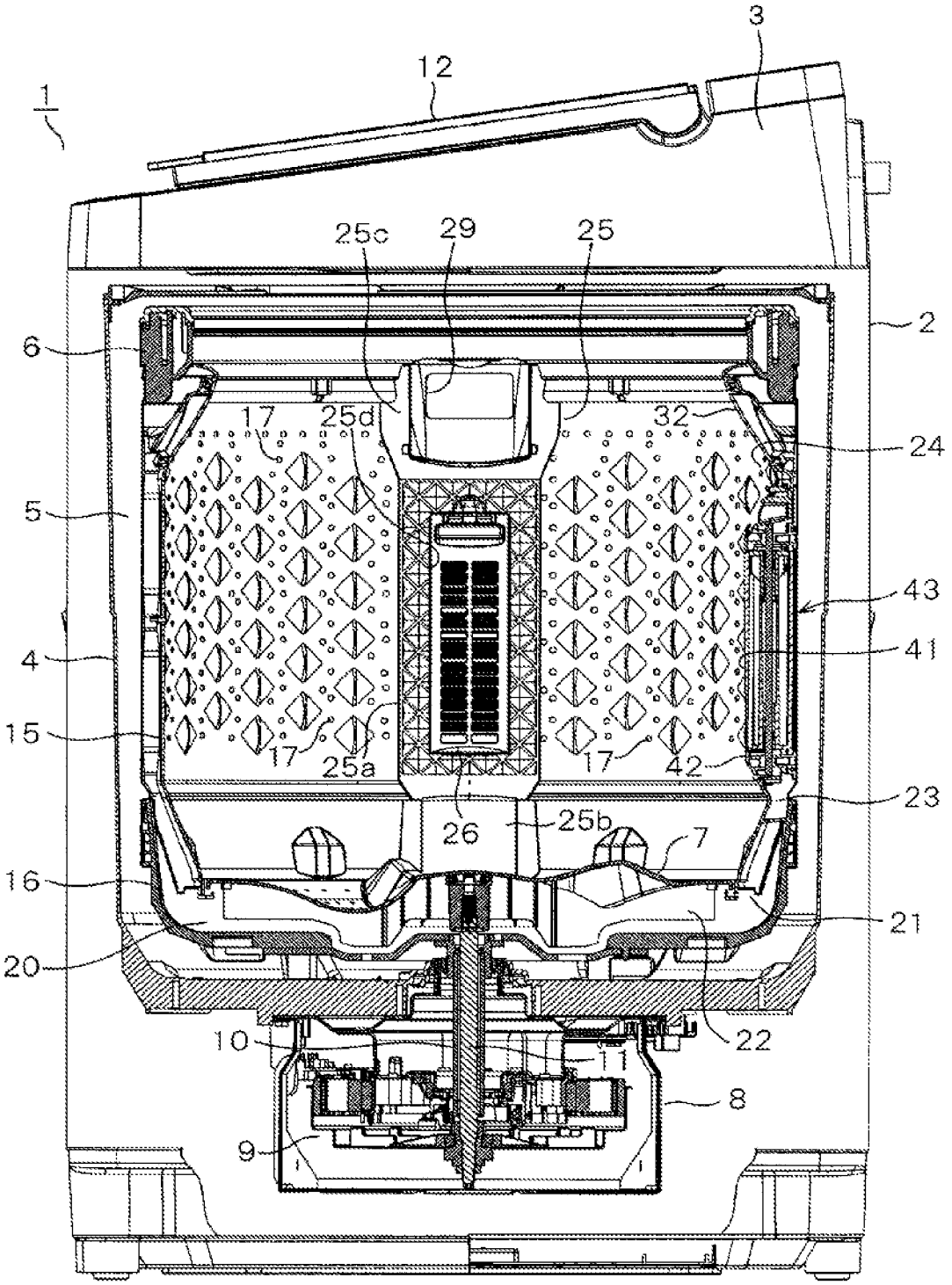
FIG. 1 is a longitudinal sectional side view schematically illustrating a structure of a washing machine according to a first embodiment.

Some embodiments applied to a washing machine (fully automatic washing machine) of a so-called vertical axis type will be described below with reference to the drawings. A substantially common portion among the plurality of embodiments is designated as a same reference numeral to eliminate an additional illustration and duplicated description.

(1) First Embodiment

A first embodiment will be described with reference to FIGS. 1 to 14. First, a general structure of a washing machine 1 according to the present embodiment will be described with reference to FIG. 1. The washing machine 1 includes a top cover 3 made of plastic, which is provided in an upper portion of an outer casing 2 that is formed of a steel plate in the shape of a rectangular box as a whole, for example. In the outer casing 2, a water tank 4 capable of storing washing water is provided by being elastically suspended and supported by an elastic suspending assembly (not illustrated) with a well-known structure. While there is no illustration, an outlet is formed in the bottom of the water tank 4, and a drain passage provided with a drain valve is connected to the outlet.

Figure 2:
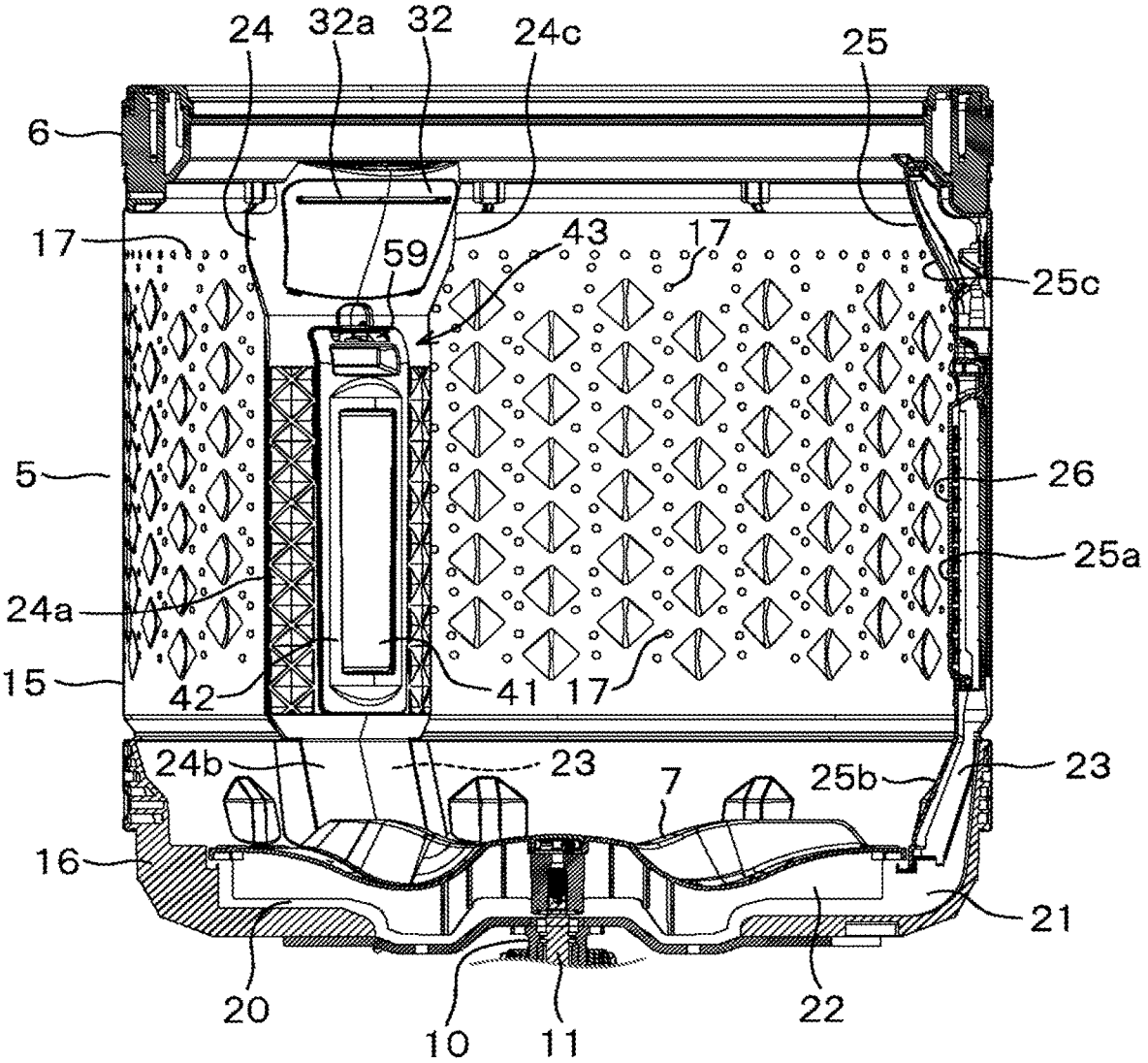
FIG. 2 is a longitudinal sectional view illustrating the structure of the washing tub according to the first embodiment in a section different from that of FIG. 1.

In the water tank 4, a washing tub (rotating tub) 5 of a vertical axis type, also serving as a spin tub, is rotatably provided. As illustrated in FIG. 2, the washing tub 5 has a bottomed cylindrical shape as a whole, and many drain holes 17 are formed in its circumferential wall portion. At an upper end of the washing tub 5, a rotating balancer 6 of a liquid-sealed type is attached, for example. In addition, a pulsator 7 is disposed at the inner bottom of the washing tub 5. The washing tub 5 is configured to house laundry (not illustrated) therein, and washing operation including steps of washing, rinsing, dewatering, and the like of clothes, is performed in the washing tub 5. Detailed structure in the washing tub 5 will be described below.

At the outer bottom of the water tank 4, a drive assembly 8 with a well-known structure is disposed. While detailed illustration and description are eliminated, the drive assembly 8 includes a washing machine motor 9 composed of a DC three-phase brushless motor of an outer rotor type, for example. The drive assembly 8 also includes a hollow tub shaft 10, an agitation shaft 11 passing through the tub shaft 10, a clutch assembly that selectively transmits rotational driving force of the washing machine motor to the shafts 10 and 11, for example. The washing tub 5 is coupled to the upper end of the tub shaft 10. The pulsator 7 is coupled to the upper end of the agitation shaft 11.

The clutch assembly has a solenoid as a driving source, for example, and is controlled by a control device that is mainly composed of a computer. This allows the clutch assembly to transmit driving force of the washing machine motor 9 to the pulsator 7 through the agitation shaft 11 while the washing tub 5 is fixed (stop) in steps of washing and water-saving rinsing, thereby directly and rotationally driving the pulsator 7 in forward and reverse directions. In a step of dewatering, the clutch assembly transmits driving force of the washing machine motor 9 to the washing tub 5 through the tub shaft 10 while the tub shaft 10 and the agitation shaft 11 are coupled to each other, to directly and rotationally drive the washing tub 5 (and the pulsator 7) in one direction at high speed.

The top cover 3 is formed in the shape of a thin hollow box whose lower face is open and top face inclines downward and forward. In a central portion of the top cover 3, a substantially circular entrance door for laundry is formed at a position above the washing tub 5. The top face of the top cover 3 is formed in the shape of a rectangular panel as a whole, and includes a lid 12 for opening and closing the entrance door. While there is no detailed illustration, an operation panel in a horizontally long shape is provided in a front edge portion of the top face of the top cover 3. There is provided a feedwater assembly for feeding water into the water tank 4 (washing tub 5) in a rear portion inside the top cover 3.

Then, the washing tub 5 will be described also with reference to FIG. 2. In detail, the washing tub 5 includes a tub bottom portion 16 that is coupled to a lower end of a body section 15 in a cylindrical shape, and the rotating balancer 6 that is coupled to an upper end of the body section 15. The body section 15 is formed of a metal plate, such as a stainless steel plate, in the shape of a cylinder with open upper and lower faces. The body section 15 includes the many drain holes 17 for dewatering that are formed in a portion other than a portion where a water passage described below is formed (a portion to which a cover member is attached). The tub bottom portion 16, which is made of plastic, is formed in the shape of a circular container and joined to a lower portion of the body section 15 by crimping and screwing.

The tub bottom portion 16 is configured such that its inner bottom (top face) includes a circular area where a pump chamber 20 is formed between the circular area and the pulsator 7. The tub bottom portion 16 also has an outer peripheral portion in which an outflow port 21 is formed at each of three positions being 120 degrees apart from each other in a circumferential direction. The pulsator 7 is formed in the shape of a disk, and has projecting portions for creating a water flow on its face (top face). In a back face of the pulsator 7, a plurality of pump blades 22 extending radially in the shape of a thin plate is integrally provided to be positioned in the pump chamber 20. This constitutes a centrifugal pump, so that washing liquid (water or water in which detergent is dissolved) in the washing tub 5 is discharged toward an outer periphery (three outflow ports 21) of the pump chamber 20 by rotation of the pulsator 7.

In a side wall portion of the washing tub 5, there is provided a water passage (pumping water passage) 23 that is used to pump up washing liquid in the washing tub 5 through each of the outflow ports 21 of the pump chamber 20 and to discharge (sprinkle) the washing liquid from an upper portion of the washing tub 5. Here, a plurality of water passages 23, such as three water passages 23, extending vertically is provided at respective positions being 120 degrees apart from each other in a circumferential direction of the washing tub 5. In this case, each of the water passages 23 from the tub bottom portion 16 (outflow port 21 portion) to the body section 15 of washing tub 5 is formed when a cover member is attached.

At this time, in the present embodiment, when the three water passages 23 are formed, a first cover member 24 is provided at each of the two places in the washing tub 5. In the other one place, there is provided a second cover member 25 that is different from the first cover member 24 in structure. The first cover member 24 is configured so that a roller (roller unit) is attached thereto. Structure of the first cover 24 and the roller (roller unit) will be described below.

The second cover member 25 is formed of a plastic molding, and formed in a substantially plate shape long in a vertical direction as a whole, as illustrated in FIGS. 1 and 2. The second cover member 25 includes a main portion 25*a* that is disposed on an inner peripheral surface side of the body section 15. Along with this, the second cover member 25 integrally includes a lower coupling portion 25*b* that is provided in a lower portion of the main portion 25*a* to be coupled to the outflow port 21 of the tub bottom portion 16, and an extension portion 25*c* provided to extend upward and inward from an upper portion of the main portion 25*a* to the rotating balancer 6. The main portion 25*a* has a cross section in the shape of an arc that curves toward an opposite side to a curved surface of the body section 15.

As illustrated in FIG. 1, a rectangular opening 25*d* that is vertically long is formed in the main portion 25*a* of the second cover member 25. A filter member 26 is detachably attached so as to block the rectangular opening 25*d*. While there in no detailed illustration, the filter member 26 is formed in the shape of a rectangular plate as a whole, and includes a plurality of water passing holes each of which is formed in the shape of a slit that is horizontally long, being provided in a surface of the rectangular plate, and a net-like filter for capturing lint, which is attached over the water passing hole, as known well.

In the extension portion 25*c* of the second cover member 25, there is provided a detergent input port 29 that is positioned below the rotating balancer 6 and is open in an inner wall portion of the washing tub 5. While there is no detailed description, the second cover member 25 formed as described above is attached to the washing tub 5 by fitting a fitting claw and a fitting hole to each other, for example. At this time, while there is no illustration, there is provided a packing along right and left edge portions of FIG. 1 on a back face of the cover member 25. The packing seals a space between the back face of the cover member 25 and the internal wall surface of the washing tub 5 in a watertight manner to form the water passage 23.

When starting washing operation, a user can previously input the amount of detergent required through the detergent input port 29. When the washing operation is started to rotate the pulsator 7, washing water in the washing tub 5 is circulated so as to rise from the outflow port 21 of the pump chamber 20 through the water passage 23 to be supplied into the washing tub 5 through the water passing holes of the filter member 26. At the time, the input detergent is fed into the washing tub 5 while being dissolved in water. Then, lint contained in the washing water is captured by a filter of the filter member 26. When the filter member 26 is detached from the second cover member 25, the filter can be easily cleaned.

The first cover member 24 will now be described also with reference to FIGS. 3A to 6. The first cover member 24 is formed of a plastic molding, and has an outline that is almost the same as that of the second cover member 25 described above. That is, the first cover member 24 is formed in a substantially plate shape long in a vertical direction as a whole, and includes a main portion 24*a* that is disposed on the inner peripheral surface side of the body section 15. Then, the first cover member 24 integrally includes a lower coupling portion 24*b* that is provided in a lower portion of the main portion 24*a* to be coupled to the outflow port 21 of the tub bottom portion 16, and an extension portion 24*c* provided to extend upward and inward from an upper portion of the main portion 24*a* to the rotating balancer 6.

Figure 3A:
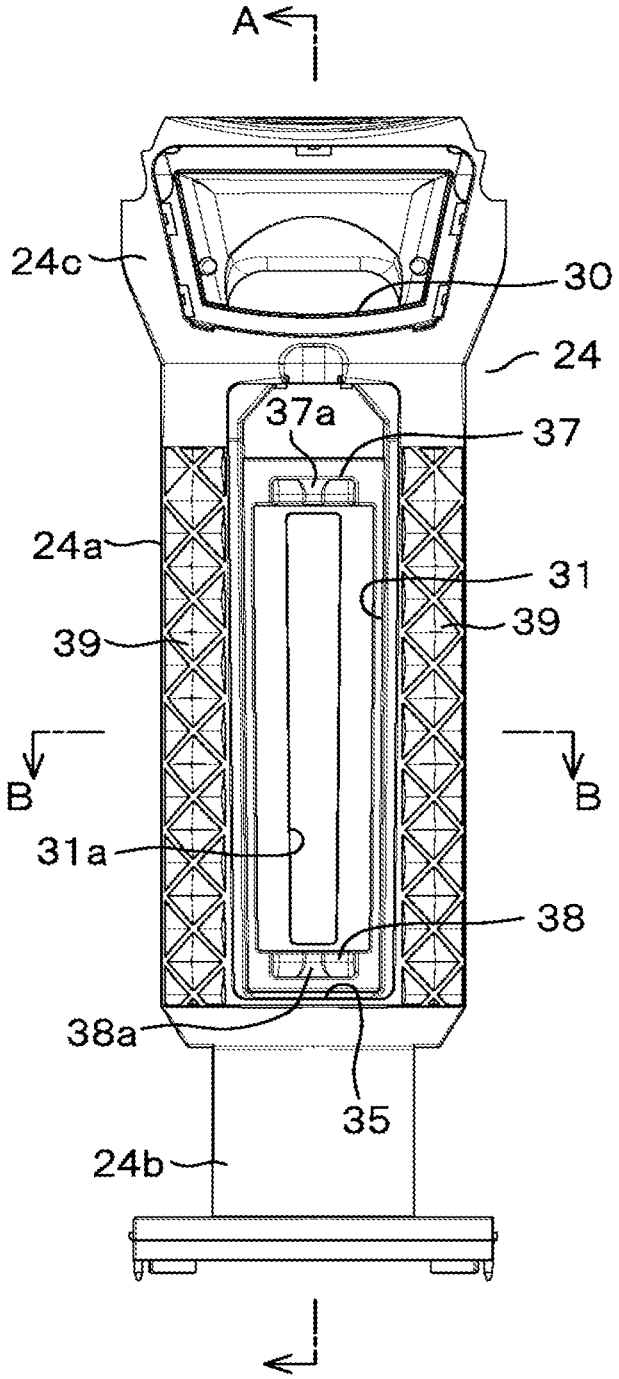
FIG. 3A is a front view of a first cover member according to the first embodiment.
Figure 3B:
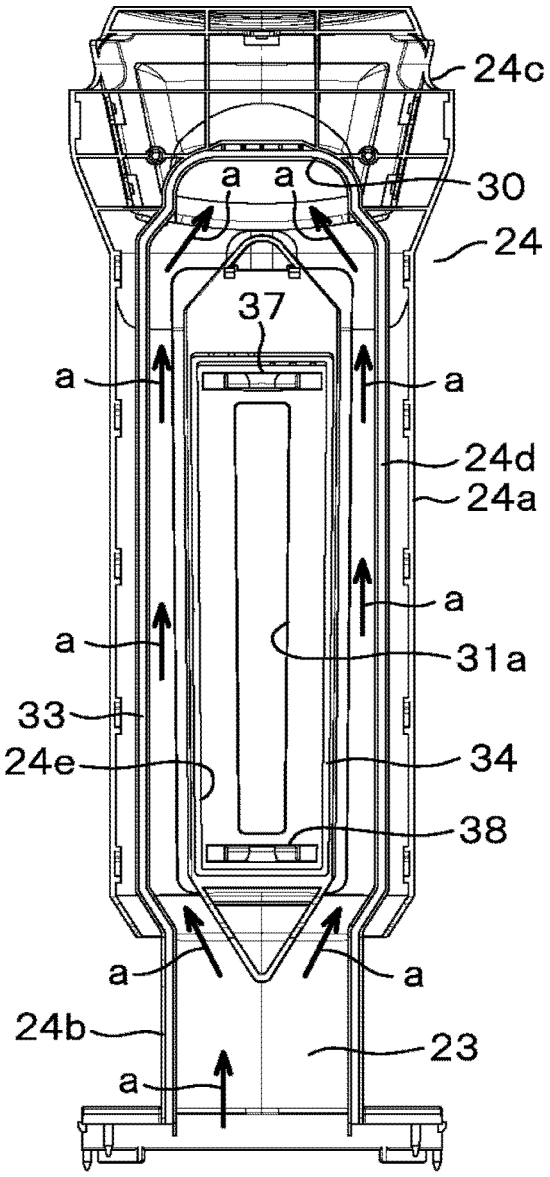
FIG. 3B is a rear view of the first cover member according to the first embodiment.
Figure 5:
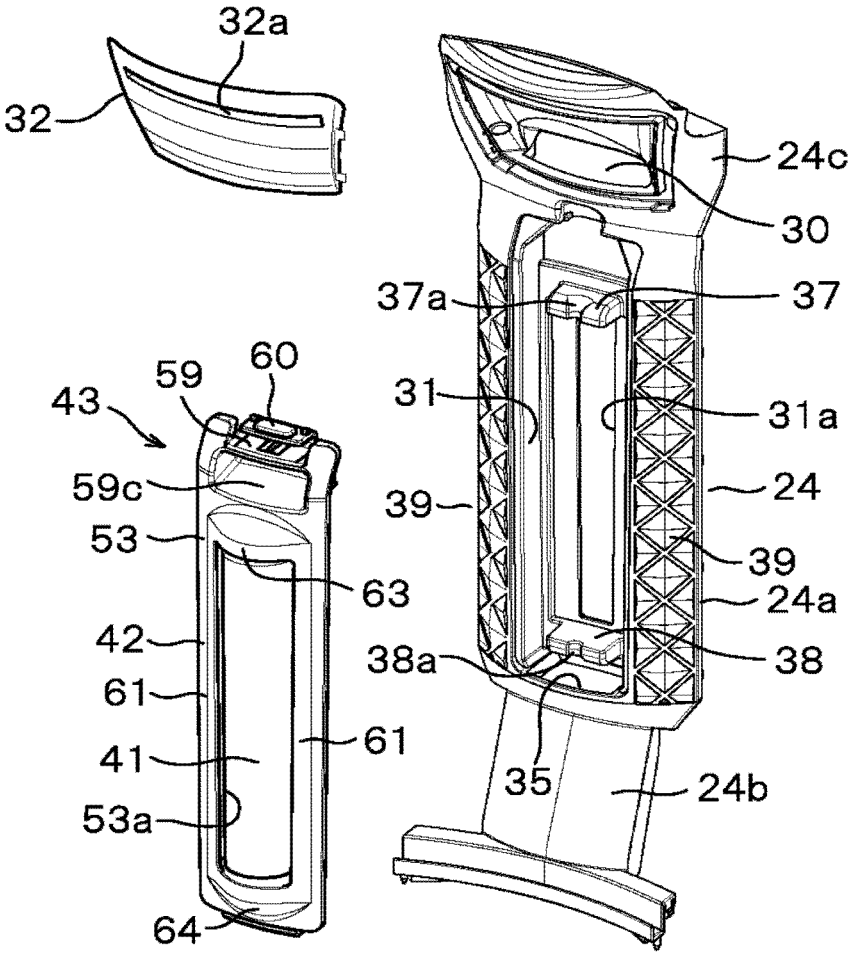
FIG. 5 is a perspective view illustrating a state of a roller unit before being attached to the first cover member according to the first embodiment.

As illustrated in FIGS. 3A and 3B, the extension portion 24*c* has a front face with an opening in an inverted trapezoidal shape, and is formed in a thin shape recessed backward to be connected to an upper end of the main portion 24*a* on a back face side (water passage 23) through a communication port 30 formed in a bottom portion of a back wall of the extension portion 24*a*. In addition, as illustrated in FIG. 5, a discharge port cover 32 is attached to the opening in the front face of the extension portion 24*c* to block the opening. In the discharge port cover 32, a discharge port 32*a* in the shape of a slit that is horizontally long is formed at a position close to an upper portion of the discharge port cover 32.

Figure 4A:
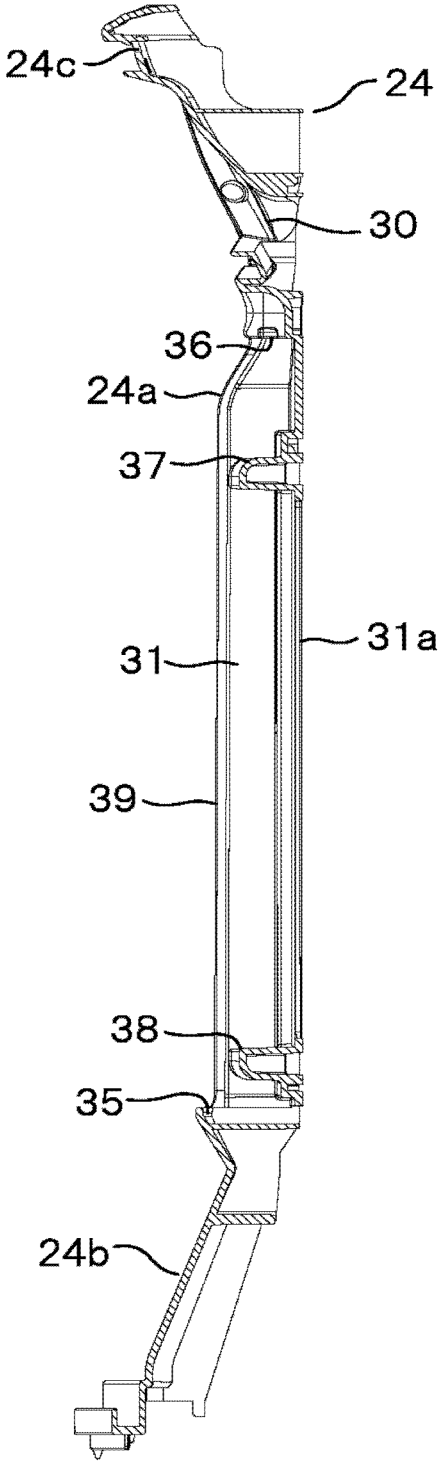
FIG. 4A is a longitudinal sectional side view of the first cover member according to the first embodiment taken along line A-A of FIG. 3A.
Figure 4B:
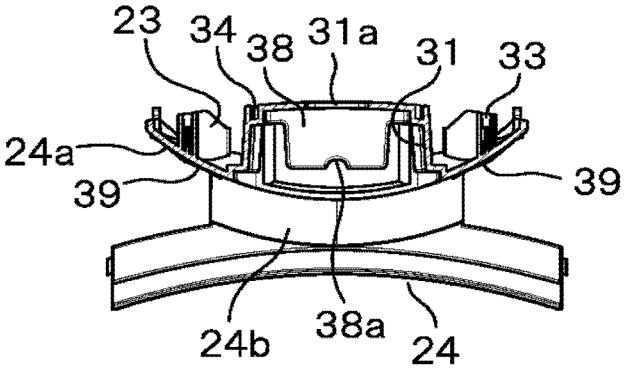
FIG. 4B is a cross sectional top view of the first cover member according to the first embodiment taken along line B-B of FIG. 3A.

As illustrated in FIG. 4B, the main portion 24*a* has a cross section in the shape of an arc that curves toward an opposite side to the curved surface of the body section 15, as a whole. In a rectangular area that is vertically long in a front face portion of the main portion 24*a*, there is provided an attachment section 31 in a recessed shape, in which a roller unit described below is detachably attached. The attachment section 31 is formed in the shape of a rectangular case that is vertically long, and includes right and left sidewalls, a back wall, and a front face that is open. In the back wall of the attachment section 31, an opening 31*a* being vertically long is formed in a back face of a portion where a roller described below is disposed. The roller described below is provided in a form separated from the water passage 23.

Figure 13:
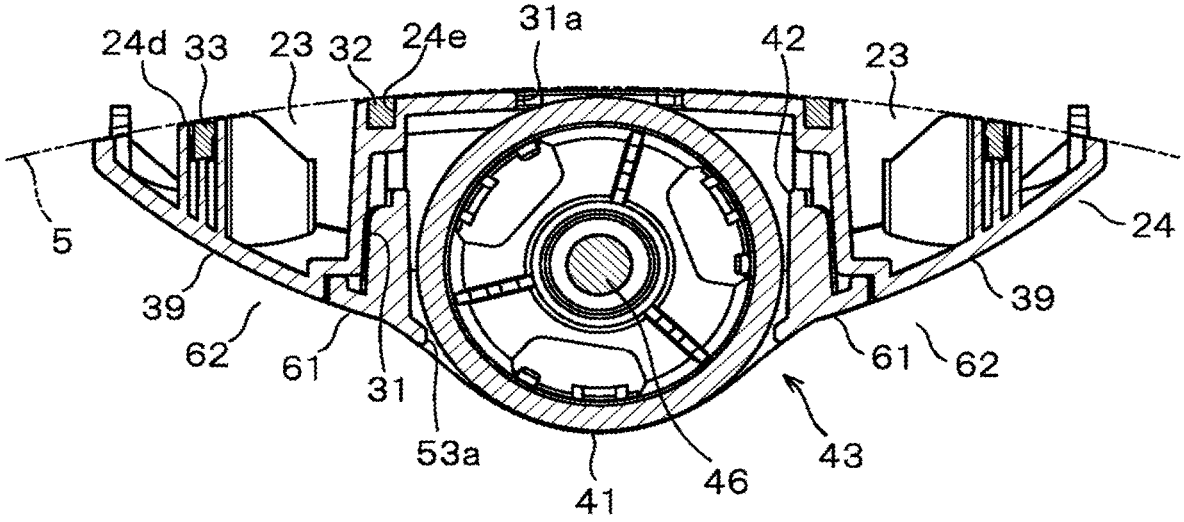
FIG. 13 is a cross sectional top view illustrating the roller and side expanded portions according to the first embodiment.

In this case, as also illustrated in FIG. 13, right and left portions of the opening in the front face of the attachment section 31 in the main portion 24*a* is formed as the corresponding cover-side-curved walls 39 and 39 that gradually expand toward an inner periphery side from right and left ends of the opening toward a center portion, respectively, as viewed from above. As described in detail below, the cover-side-curved walls 39 and 39 constitute the corresponding side expanded portions together with a curved wall of a holding member (holding-member-side curved wall).

While there is no detailed description, the first cover member 24 is also attached to the washing tub 5 by fitting a fitting claw and a fitting hole to each other, for example. Then, as illustrated in FIG. 3B, an outer packing holding groove 24*d* and an inner packing holding groove 24*e* are integrally provided in a back face of the first cover member 24. The outer packing holding groove 24*d* extends upward in right and left side edge portions throughout the main portion 24*a* and the bottom coupling portion 24*b* of the first cover member 24. In addition, the outer packing holding groove 24*d* is formed in an inverted U-shaped form so as to be connected immediately above the communication port 30. The inner packing holding groove 24*e* is formed in the shape of a rectangular frame that is vertically long so as to surround an outer periphery of the attachment section 31 (opening 31*a*) described above.

In the outer packing holding groove 24*d*, an outer packing 33 in the shape of an open-ended belt is held. This allows a space between the back face of the first cover member 24 and an internal wall surface of the body section 15 along an outer periphery of the water passage 23 to be sealed in a watertight manner. In the inner packing holding groove 24*e*, an inner packing 34 in the shape of a frame is held. This allows a space between the back face of the first cover member 24 and the internal wall surface of the body section 15 along an outer peripheral portion of the opening 31*a* to be sealed in a watertight manner.

As described above, the water passage 23 for raising washing water is formed between the first cover member 24 and an inner periphery wall of the washing tub 5 (body section 15). In this case, as illustrated in FIG. 3B, the water passage 23 extends upward from the outflow port 21 to a bottom portion of the attachment section 31, as indicated by an arrow "a". The water passage 23 then forks into two branches to extend upward in the right and left across the attachment section 31 (opening 31*a*). The two branches are unified again above the attachment section 31 to reach the communication port 30. Washing water having passed through the communication port 30 flows into the extension portion 24*a* (front face side), and is discharged into the washing tub 5 through the discharge port 32*a* of the discharge port cover 32. In this case, the water passage 23 is positioned at each of the side portions across the roller described below.

Then, as illustrated in FIG. 4A, the attachment section 31 of the first cover member 24 includes a fitted portion 35 positioned in a lower edge portion of the attachment section 31 to fit a fitting piece of the roller unit described below. In addition, in an upper edge portion of the attachment section 31, there is provided a fitting hole 36 into which a fitting projecting portion of the roller unit described below is to be fitted. The attachment section 31 further includes an upper holding section 37 and a lower holding section 38 that are positioned in an upper portion and a lower portion of the opening 31*a* to hold upper and lower ends of a shaft of the roller described below, respectively, in a state where the shaft is prevented from coming off. The upper holding section 37 and the lower holding section 38 include respectively recessed portions 37*a* and 38*a* each formed in a U-shape at a central portion of a leading end face on one side of an oblong plate projecting forward.

Figure 6:
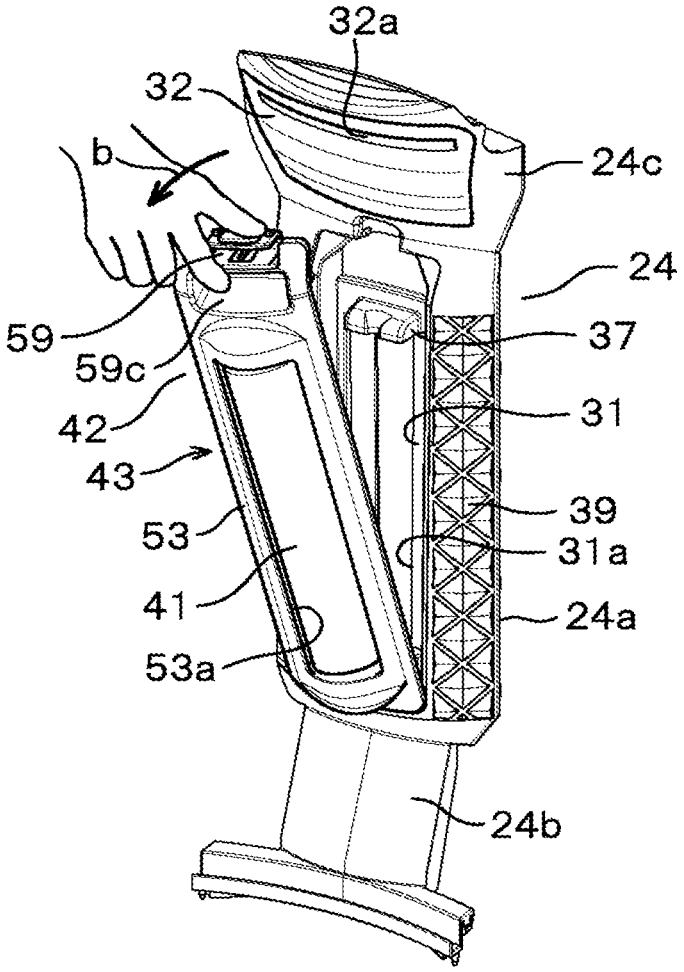
FIG. 6 is a perspective view illustrating a state of the roller unit in the middle of being detached from the first cover member according to the first embodiment.

As illustrated in FIGS. 1 and 2, and the like, a roller 41 in a cylindrical shape is rotatably provided in the inner wall portion of the washing tub 5 described above with its axis vertically oriented and is rotated to facilitate movement of laundry. As illustrated in FIGS. 5 and 6, and the like, the roller 41 is held by a holding member 42 to form a roller unit 43 in the present embodiment. The roller 41 is detachably attached to the attachment section 31 of the first cover member 24 in a state of the roller unit 43. The roller 41 and the roller unit 43 will be described in detail below also with reference to FIGS. 7A to 14.

Figure 9:
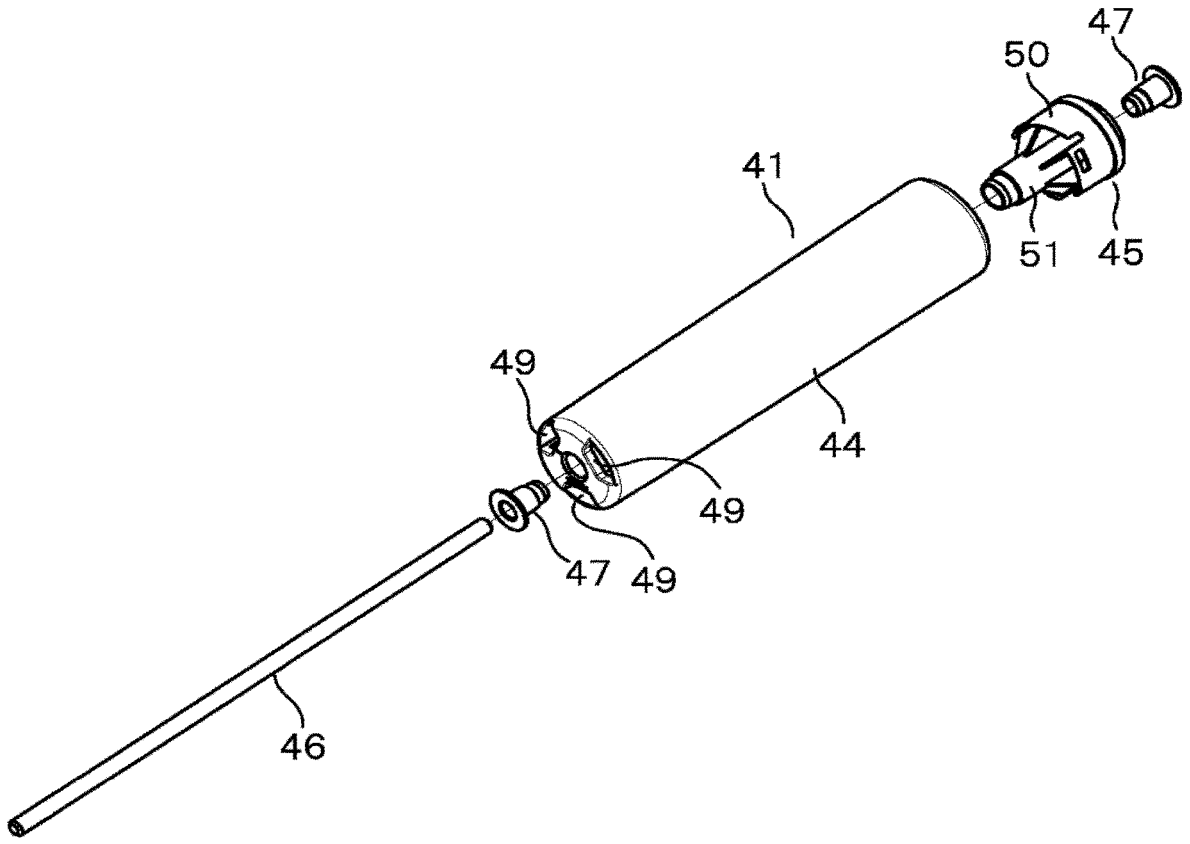
FIG. 9 is an exploded perspective view of a roller according to the first embodiment.
Figure 10A:
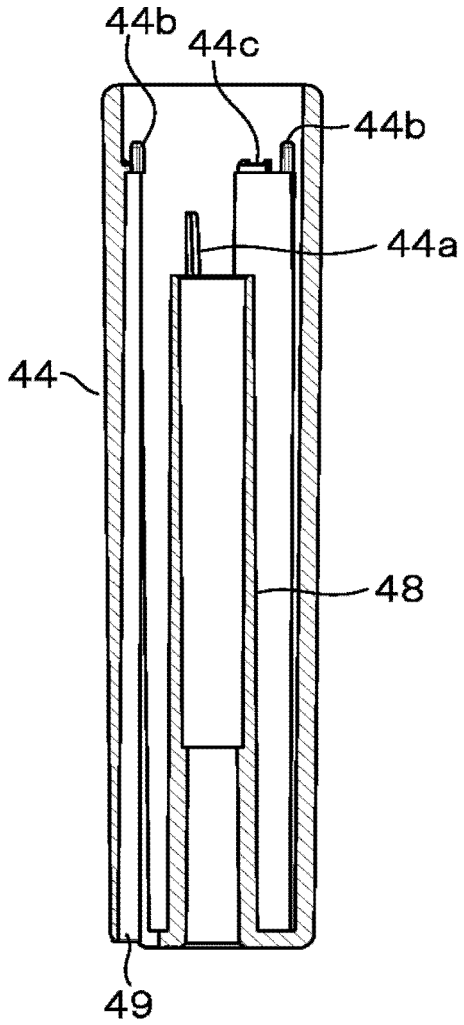
FIG. 10A is a longitudinal sectional view of a main portion of the roller according to the first embodiment.
Figure 10B:
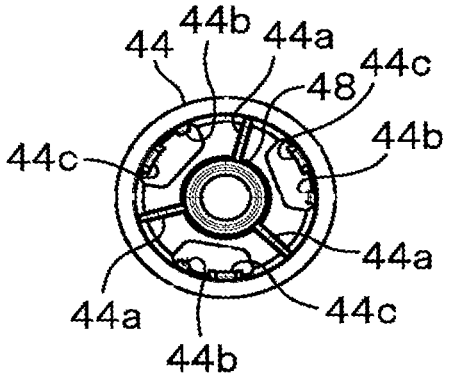
FIG. 10B is a top view of the main portion of the roller according to the first embodiment.
Figure 10C:
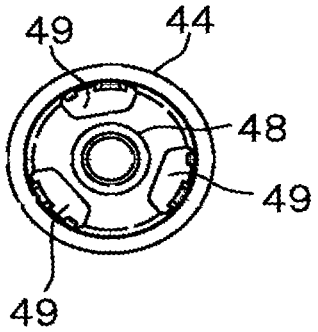
FIG. 10C is a bottom view of the main portion of the roller according to the first embodiment.

First, the roller 41 will be described. As illustrated in FIG. 9 and the like, the roller 41 includes a roller main portion 44, a cap part 45, a shaft 46 made of metal, and upper and lower bushes 47 and 47. The roller main portion 44 is formed of a plastic molding, and is formed in a hollow cylindrical shape that has an open top face (a lower end face has a bottom wall) and that is vertically long, as also illustrated in FIGS. 10A to 10C. The roller main portion 44 also integrally includes a cylindrical portion 48 that extends to its bottom face (lower end face) and into which the shaft 46 is inserted to be held. The cylindrical portion 48 is formed in the shape of a circular pipe, and is provided so as to extend axially (upward) to near an upper portion of the roller main portion 44 along a shaft center portion of the roller main portion 44.

Then, three openings 49 are formed in the bottom face of the roller main portion 44 as illustrated in FIG. 10C. The openings 49 are disposed at positions away from the cylindrical portion 48 as viewed from an axial direction, the positions being 120 degrees apart from each other in a circumferential direction, and communicate with an internal space of the roller main portion 44 (a space on an outer periphery side of the cylindrical portion 48). In addition, three reinforcement ribs 44*a* are integrally formed in an inner peripheral surface of the roller main portion 44 at respective positions being 120 degrees apart from each other in a circumferential direction so as to extend to an outer peripheral portion of the cylindrical portion 48, as illustrated in FIG. 10B. Further, three pairs of a fitting pin 44*b* and a hook 44*c* are integrally provided in an upper portion of the inner peripheral surface of the roller main portion 44 at respective positions being 120 degrees apart from each other in a circumferential direction to be coupled to the cap part 45.

Figure 11A:
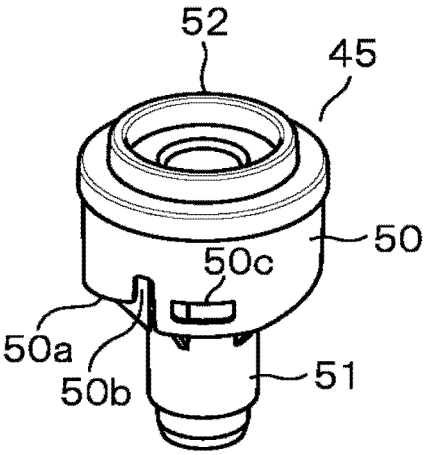
FIG. 11A is a perspective view of a cap part according to the first embodiment.
Figure 11B:
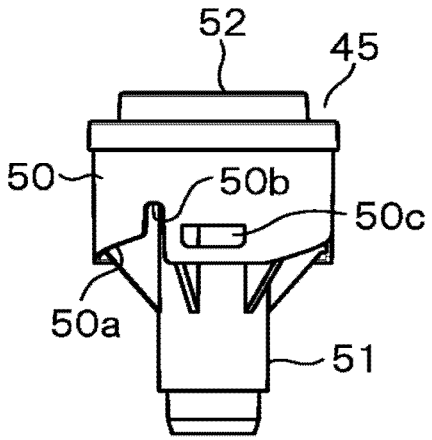
FIG. 11B is a front view of the cap part according to the first embodiment.
Figure 11C:
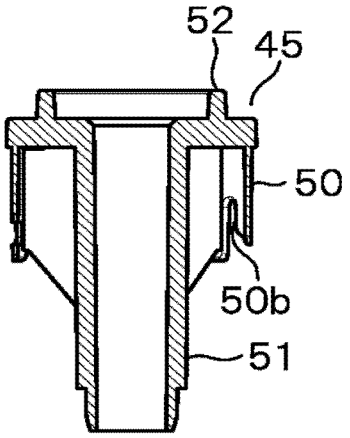
FIG. 11C is a longitudinal sectional side view of the cap part according to the first embodiment.

As compared with the roller main portion 44, the cap part 45 is also formed of a plastic molding, and is formed in the shape of a cylindrical cap. As illustrated in FIGS. 11A to 11C, the cap part 45 integrally includes a cylindrical wall portion 50 that extends downward from a lower face of a disk-like portion constituting an upper end face of the roller 41 to fit into the inner peripheral surface of the roller main portion 44. At a shaft center portion of the cap part 45, there is integrally provided a cylindrical portion 51 that extends downward to pass through the shaft center portion vertically and into which the shaft 46 is inserted.

As illustrated in FIGS. 11A and 11B, at each of three places in a circumferential direction of the cylindrical wall portion 50, there is provided a cam portion 50*a* that is formed by cutting a leading end portion of the cylindrical wall portion 50 at an angle and with which the fitting pin 44*b* of the roller main portion 44 is brought into contact to be relatively guided. In addition, a fitting recessed portion 50*b* being provided at a trailing end of the cam portion 50*a* so as to be recessed upward, and being fitted and fixed to the fitting pin 44*b* is provided. Further, in the cylindrical wall portion 50, there is provided three fitting holes 50*c* into each of which the hook 44*c* of the roller main portion 44 is fitted in a state where the hook 44*c* is prevented from coming off.

Then, the cap part 45 is rotated right with respect to an upper end of the roller main portion 44 after the cam portion 50*a* of the cylindrical wall portion 50 is fitted to the fitting pin 44*b* so as to be brought into contact with it. This allows the fitting pin 44*b* to be fitted and fixed in the fitting recessed portion 50*b* and the hook 44*c* to be fitted into the fitting hole 50*c*, and then the cap part 45 is attached to the roller main portion 44.

Figure 12A:
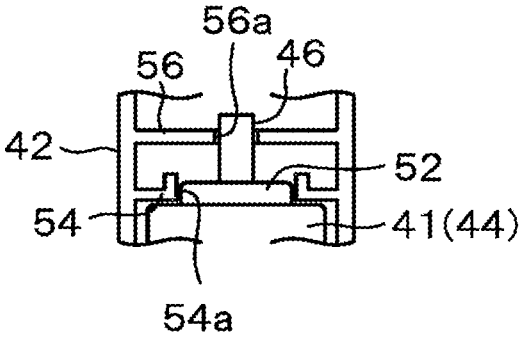
FIG. 12A is a rear view illustrating an upper portion of a supporting structure of a shaft of the roller according to the first embodiment.
Figure 12B:
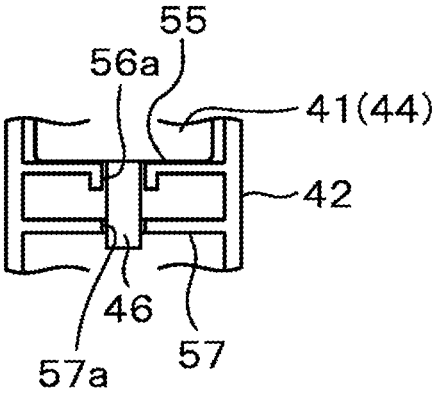
FIG. 12B is a rear view illustrating a lower portion of the supporting structure of the shaft of the roller according to the first embodiment.

As also illustrated in FIG. 11C, in a top face of the cap part 45, being the upper end face of the roller 41, there is integrally provided a rib 52 for preventing a cloth from being caught. As also illustrated in FIG. 12A, the rib 52 is provided on an outer periphery side of the shaft 46, and is formed in the shape of a ring erected upward (low cylindrical shape). As described below, the rib 52 blocks a gap between the roller 41 and a top side of a rectangular opening 53*a* of the holding member 42 to prevent a cloth of laundry from being caught in the gap. As also described below, the rib 52 also serves as a wrong-assembly preventing member that allows the roller 41 to be held when it is placed in the correct direction with respect to the holding member 42, but that does not allow the roller 41 to be held when it is placed in an incorrect direction.

Figure 7A:
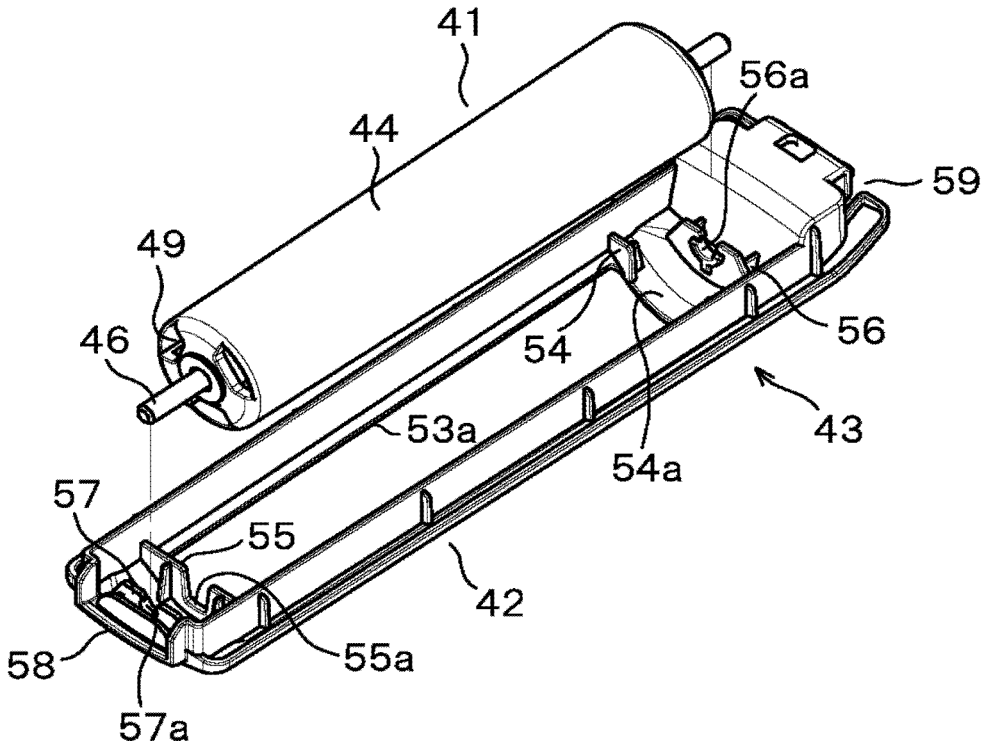
FIG. 7A is an exploded perspective view of the roller unit according to the first embodiment as viewed from its back face side.

The roller 41 is assembled by attaching the cap part 45 to the roller main portion 44 as described above and by inserting the shaft 46 into the cylindrical portion 48 and the cylindrical portion 51 so that the shaft 46 is fixed by the upper and lower bushes 47 and 47. As illustrated in FIG. 7A, this allows the roller 41 to be formed in a state where the shaft 46 passes through a shaft center portion of the roller 41 and projects by a little length upward and downward from the corresponding upper and lower end faces of the roller 41.

With respect to the roller 41 with the structure described above, the holding member 42 is formed as follows. That is, as illustrated in FIGS. 7A, 7B, and 8A to 8C, the holding member 42 is formed of a plastic molding, and is formed in a rectangular shape being vertically long so as to block the attachment section 31 of the first cover member 24 as a whole. Then, the holding member 42 is also formed in the shape of a case whose back face is open and that is thin in a fore-and-aft direction. The holding member 42 has a front face central portion that forms an expanded portion 53 having an arc-like (barrel-type) shape expanding forward as viewed from its top face. In addition, the expanded portion 53 is provided with a rectangular opening 53*a* to expose a part of an outer peripheral surface of the roller 41 (an area less than half of the entire area). The rectangular opening 53*a* is formed to have a vertical length corresponding to a length of the roller 41, allowing the roller 41 to be fit.

Figure 8A:
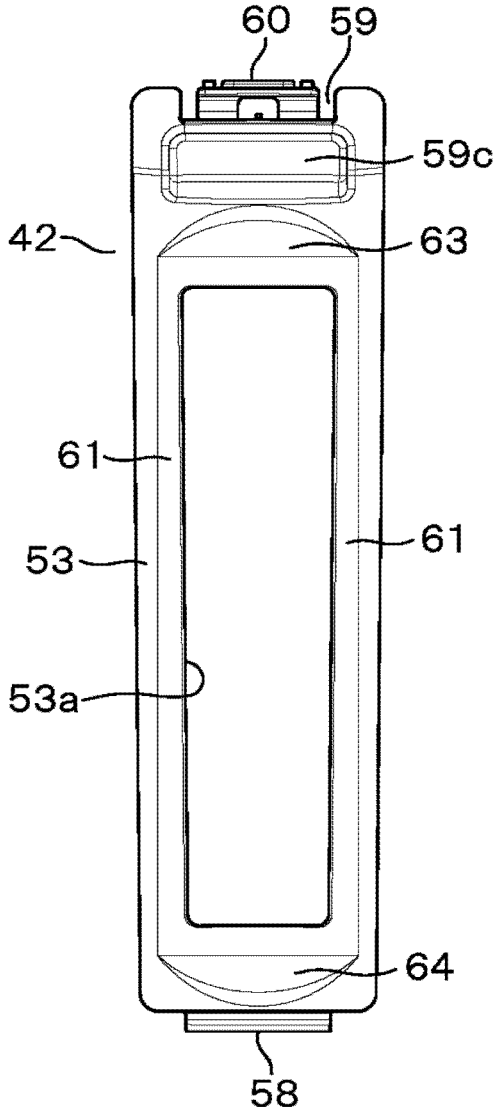
FIG. 8A is a front view of a holding member according to the first embodiment.

Then, as illustrated in FIGS. 8A and 13, and the like, portions positioned right and left across the opening 53*a* form corresponding holding-member-side curved walls 61 and 61 as curved walls in a front face portion of the expanded portion 53 of the holding member 42. As described below, the holding-member-side curved walls 61 and 61 extend to the corresponding cover-side-curved walls 39 and 39 to form corresponding side expanded portions 62 and 62 with the corresponding cover-side-curved walls 39 and 39. The side expanded portions 62 and 62 are provided at the corresponding both side portions across the roller 41, and extend so as to form a smooth curve along an exposed outer periphery wall surface of the roller 41, thereby serving to smoothly guide laundry toward the roller 41. In the present embodiment, the holding-member-side curved walls 61 and 61 each are formed in a shape in which a curvature as viewed from above changes so as to be further close to that of the outer peripheral surface of the roller 41 near the roller 41.

Figure 8B:
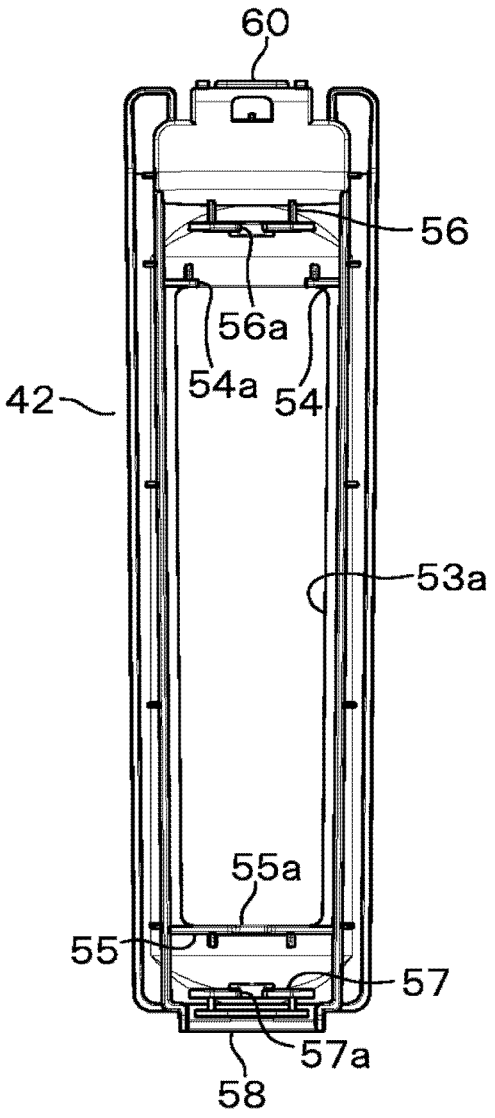
FIG. 8B is a rear view of the holding member according to the first embodiment.
Figure 8C:
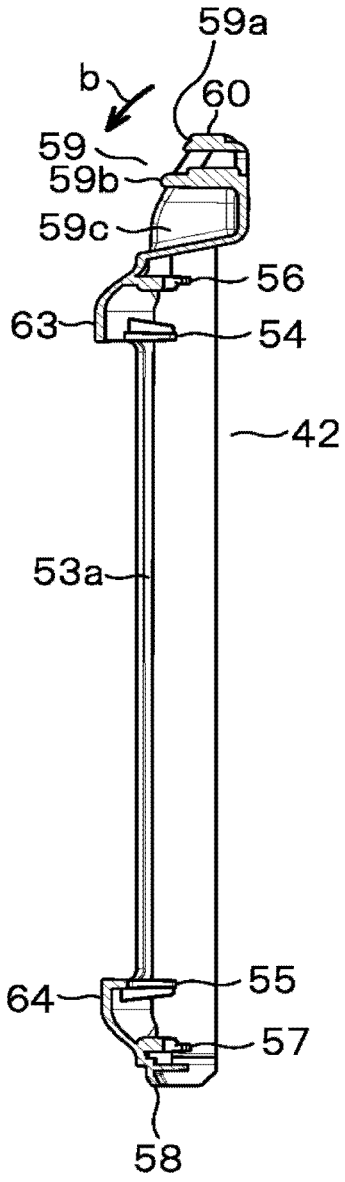
FIG. 8C is a longitudinal sectional side view of the holding member according to the first embodiment.

As illustrated in FIG. 8C, a portion of the front face portion of the expanded portion 53 of the holding member 42 positioned at an upper portion of the opening 53*a* forms an upper expanded portion 63. In addition, a portion positioned at a lower portion of the opening 53*a* forms a lower expanded portion 64. The upper expanded portion 63 is provided in an upper portion of the roller 41 in a form of smoothly extending to an upper end of the roller 41. Likewise, the lower expanded portion 64 is provided in a lower portion of the roller 41 in a form of smoothly extending to a lower end of the roller 41.

As illustrated in FIGS. 7A, 8B, 12A, and 12B, an upper wall portion 54 is integrally provided in an upper end portion of the rectangular opening 53*a* on a back face (inner surface) side of the holding member 42. In addition, a lower wall portion 55 is integrally provided in a lower end portion of the rectangular opening 53*a* on a back face side of the holding member 42. Then, in the upper wall portion 54, a wide upper cutout portion 54*a* in which the rib 52 of the roller 41 can be disposed or through which it can pass is formed so as to open toward a back face side of the upper wall portion 54. In the lower wall portion 55, a narrow lower cutout portion 55*a* through which the shaft 46 of the roller 41 can pass is formed so as to open toward a back face side of the lower wall portion 55.

As illustrated in FIGS. 7A, 7B, and 8A to 8C, on the back face (inner surface) side of the holding member 42, an upper bearing portion 56 is integrally provided at a position rather above the upper wall portion 54 to rotatably support an upper end portion of the shaft 46 of the roller 41. In addition, a lower bearing portion 57 is integrally provided at a position rather below the lower wall portion 55 to rotatably support a lower end portion of the shaft 46 of the roller 41. The upper bearing portion 56 and the lower bearing portion 57 respectively include U-shaped cutout portions 56*a* and 57*a* being open toward the corresponding back face sides. The upper bearing portion 56 and the lower bearing portion 57 rotatably support the roller 41 when the shaft 46 of the roller 41 is inserted into the cutout portions 56*a* and 57*a* from the corresponding back face sides.

Further, a structure for detachably attaching the roller unit 43 to the attachment section 31 of the first cover member 24 is provided in the holding member 42 as follows. That is, as illustrated in FIGS. 7A, 7B, and 8A to 8C, a fitting piece 58 projecting downward in a horizontally long shape is integrally provided in a lower end portion of the holding member 42. When the fitting piece 58 is inserted into the fitted portion 35 of the attachment section 31 from above, the lower end portion of the holding member 42 is fitted in a state where the lower end portion is prevented from coming off forward.

Meanwhile, as illustrated in FIGS. 8A to 8C, a knob portion 59 is integrally provided in an upper end portion of the holding member 42. The knob portion 59 includes an upper piece portion 59*a* and a lower piece portion 59*b* up and down, the piece portions extending forward from a wall portion on an upper-end-back-face side of the holding member 42, and the upper piece portion 59*a* and the lower piece portion 59*b* are elastically deformable vertically. Then, as illustrated in FIG. 6, a recessed portion 59*c* into which a user can insert his/her finger and that is formed in a recessed shape having an open front face is provided below the lower piece portion 59*b*. The upper piece portion 59*a* is positioned at an upper end of the holding member 42, and has a top face including a fitting projecting portion 60 that is detachably fitted into the fitting hole 36 of the attachment section 31, as illustrated in FIG. 5. This allows a user to elastically deform the upper piece portion 59*a* downward (in a direction of an arrow "b" of FIG. 8C) by vertically gripping the knob portion 59 so as to narrow a distance between the upper piece portion 59*a* and the lower piece portion 59*b*. In this state, the fitting projecting portion 60 can be attached to or detached from the fitting hole 36.

In the roller unit 43 with the structure described above, the roller 41 is housed in the holding member 42 from a back face side of the holding member 42, and is held in the expanded portion 53, as illustrated in FIG. 7A. Specifically, the upper end portion of the shaft 46 of the roller 41 is inserted into the cutout portion 56*a* of the upper bearing portion 56 to be rotatably supported. Then, the rib 42 in an upper end face portion of the roller 41 is disposed in the wide upper cutout portion 54*a* of the upper wall portion 54. In addition, the lower end portion of the shaft 46 is inserted into the cutout portion 57*a* of the lower bearing portion 57 to be rotatably supported. Then, a portion of the shaft 46 just below a lower end face of the roller 41 is disposed in the narrow lower cutout portion 55*a* of the lower wall portion 55.

Figure 7B:
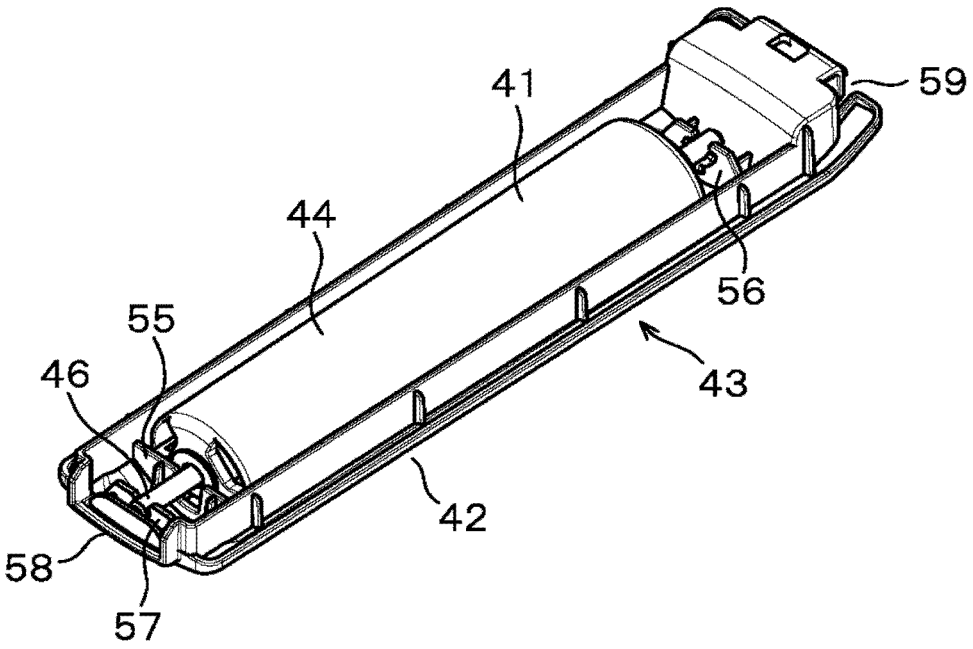
FIG. 7B is a perspective view of the roller unit according to the first embodiment as viewed from its back face side.

This allows the roller 41 to be rotatably held in the holding member 42, as illustrated in FIG. 7B and the like, and a front portion of the roller 41 (a portion within a range rather less than a semicircle thereof) is disposed in the rectangular opening 53*a* to be exposed forward. In this holding state, the rib 52 in the upper end face of the roller 41 is disposed in a gap portion between the rectangular opening 53 on the upper end face side of the roller 41 and the roller 41 to serve to prevent a cloth from being caught, as illustrated in FIG. 12A. Then, as is evident from FIGS. 12A and 12B, existence of rib 52 causes the rib 52 to be caught by the lower wall portion 55 when the roller 41 is about to be attached to the holding member 42 upside down. This forms a structure in which the roller 41 cannot be held in the holding member 42 upside down.

Then, the roller unit 43 is detachably attached to the attachment section 31 of the first cover member 24 in the inner wall portion of the washing tub 5. When the roller unit 43 is attached to the attachment section 31, first, the fitting piece 58 at a lower end of the holding member 42 is inserted into the fitted portion 35 in a lower end portion of the attachment section 31 from obliquely above to be fitted (refer to FIG. 6). Next, while the upper piece portion 59*a* is elastically deformed downward (in a direction of the arrow "b") by gripping the knob portion 59, an upper portion of the roller unit 43 is fitted into the attachment section 31. This allows the fitting projecting portion 60 to be fitted into the fitting hole 36. The roller unit 43 is attached to the first cover member 24 at each of two places.

As described above, the roller unit 43 is attached to the attachment section 31 so as to be fitted thereinto. Then, as illustrated in FIG. 1, the upper holding section 37 and the lower holding section 38 are provided in the first cover member 24 on a back face side of the roller unit 43. This allows the roller unit 43 to be prevented from coming off backward (back face side) by the upper holding section 37, in the upper end portion of the shaft 46 of the roller 41 just below the upper bearing portion 56. The roller unit 43 is also prevented from coming off backward (back face side) by the lower holding section 38, in the lower end portion of the shaft 46 just above the lower bearing portion 57.

In this attachment state of the roller unit 43, the roller 41 is rotatably disposed with its axis vertically oriented at a middle portion in the inner wall portion of the washing tub 5, as illustrated in FIGS. 1 and 2. The roller 41 itself is rotated to facilitate movement of laundry in a circumferential direction along an inner wall of the washing tub 5. Then, as illustrated in FIG. 13 and the like, the roller 41 (the center axis) is positioned inward of the inner wall portion of the washing tub 5. In the inner wall portion of the washing tub 5, the side expanded portions 62 and 62 are provided at positions in the corresponding both side portions across the roller 41, and extend so as to form a smooth curve along the exposed outer periphery wall surface of the roller 41, and the side expanded portions 62 and 62 serving to smoothly guide laundry toward the roller 41.

In the present embodiment, each of the side expanded portions 62 is formed by continuously joining the holding-member-side curved wall 61 provided in the holding member 42 and the cover-side-curved wall 39 of the first cover member 24 to each other. The holding-member-side curved wall 39 has a curvature as viewed from above that changes near the roller 41 so as to correspond to the outer peripheral surface of the roller 41, as illustrated in FIG. 13. In addition, there is provided the upper expanded portion 63 that is positioned above the roller 41, and that smoothly extends along an upper end portion of the roller 41. Further, there is provided the lower expanded portion 64 that is positioned below the roller 41, and that smoothly extends along a lower end portion of the roller 41.

Figure 14:
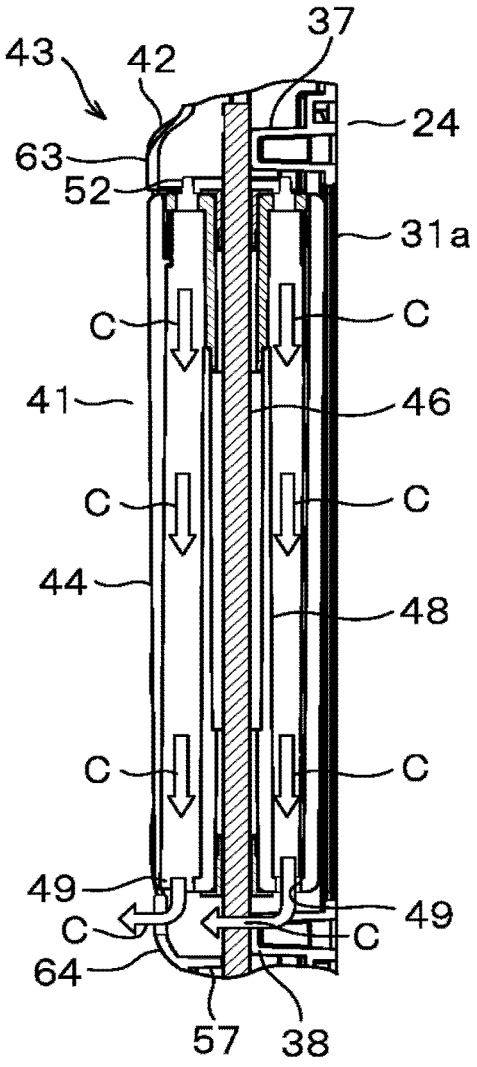
FIG. 14 is a longitudinal sectional view to describe a state of washing water entry into the roller according to the first embodiment.

In this attachment state of the roller unit 43, the openings 49 in the lower face of the roller 41 communicate with the inside of the washing tub 5 through gaps at a plurality of places in the holding member 42, as illustrated in FIG. 14. Thus, in steps of washing and water-saving rinsing, washing water in the washing tub 5 flows in a direction opposite to a direction of an arrow "c" to enter the inside of the roller 41 through the opening 49. However, when the washing water is drained from the washing tub 5, the washing water inside the roller 41 flows in the direction indicated by the arrow "c" to be drained from the inside of the roller 41 through the opening 49.

Contrary to the description above, when the roller unit 43 is detached from the attachment section 31, a user grips the knob portion 59 to elastically deform the upper piece portion 59*a* downward (in the direction of the arrow "b"). In this state, the fitting projecting portion 60 is pulled out downward from the fitting hole 36 to pull out an upper portion of the holding member 42 forward (refer to FIG. 6). Next, the fitting piece 58 is pulled out obliquely upward to release fitting to the fitted portion 35, so that the roller unit 43 can be detached. In the roller unit 43 after being detached from the washing tub 5 (attachment section 31), the roller 41 can be easily detached from or attached to the holding member 42.

Action and effect of the washing machine 1 with the structure described above will now be described. In the structure described above, the roller 41 is rotatably provided in the inner wall portion of the washing tub 5, so that movement of laundry in the washing tub 5 is facilitated to enable washing effect to be increased. In particular, when the amount of clothes of laundry in the washing tub 5 is large, the laundry is prevented from rotating, and thus stains of the laundry tend to be unevenly removed; however, the roller 41 can improve so-called laundry swirling, so that unevenness removal of stains as described above can be resolved.

The roller 41 is provided in a detachable manner from the washing tub 5, and therefore even under a condition where contamination is liable to adhere to a portion near an attachment section of the roller 41, a user can easily detach the roller 41 and clean. As a result, according to the present embodiment, the roller 41 is provided in the washing tub 5 to enable laundry swirling to be improved, and excellent effect of improving cleanability can be acquired.

In the present embodiment, the roller 41 is disposed with its axis vertically oriented in the inner wall portion of the washing tub 5. According to this, laundry swirling is improved in the inner wall portion of the washing tub 5, thereby being effective. For example, when the roller is provided on the pulsator, improvement of laundry swirling is limited to some sections such as the bottom in the washing tub. Compared to this, it is possible to widely obtain an effect of facilitating the laundry swirling.

Particularly, in the present embodiment, the roller 41 is held by the holding member 42 to be constituted as the roller unit 43, and this roller unit 43 is detachably attached to the washing tub 5. The roller 41 is constituted as the roller unit 43, so that handling such as attachment to the washing tub 5 and detachment from the washing tub 5 is also facilitated. The bearing portions 56 and 57 for rotatably holding the roller 41 are provided in the holding member 42. Thus, a portion with a complex shape, to which contamination is liable to adhere, in other words, from which contamination is hard to be removed, does not need to be provided on a washing tub 5 side, so that cleanability can be further improved.

At this time, the holding member 42 includes the knob portion 59 that is used to be gripped by fingers of hand when the roller unit 43 is attached or detached. Operation of attaching or detaching the roller unit 43 can be more easily performed by using the knob portion 59. Since the holding member 42 includes the bearing portions 56 and 57 that axially support the corresponding ends of the shaft 46 of the roller 41, this enables the roller 41 to be rotatably supported by the bearing portions 56 and 57, so that no bearing function needs to be provided in the washing tub 5.

In addition, on an end face of the roller 41, the rib 52 for preventing a cloth from being caught is provided on the outer periphery side of the shaft 46 so as to block a gap between the roller 41 and the rectangular opening 53*a* of the holding member 42. This enables the rib 52 to prevent clothes of laundry from being caught in a gap between the roller 41 and an upper edge portion of the rectangular opening 53*a*, thereby being further effective. In this case, a gap between the roller 41 and the holding member 42 is liable to increase on an upper end side of the roller 41 due to self-weight of the roller 41, as compared with that on a lower end side thereof. Thus, when the rib 52 is provided on the end face of the roller 41 on the upper side, the rib 52 is furthermore effective to prevent a cloth from being caught.

The rib 52 is also configured to serve as a wrong-assembly preventing member that allows the roller 41 to be held when it is placed in the correct direction with respect to the holding member 42, but that does not allow the roller 41 to be held when it is placed in an incorrect direction. This enables prevention of wrong assembly in which the roller 41 is assembled in an incorrect direction with respect to the holding member 42. The rib 52 also serves as the wrong-assembly preventing member, so that the rib 52 can be simply formed as compared with a case where the wrong-assembly preventing member is separately provided.

The roller 41 includes the roller main portion 44 and the cap part 45 provided in one end portion of the roller main portion 44, and is configured such that the cap part 45 is attached to the roller main portion 44 by being rotated after being fitted in the roller main portion 44. This enables the cap part 45 to be easily attached to the roller main portion 44, so that assembly work of the roller 41 can be easily performed. More specifically, the roller 41 is configured such that the fitting pin 44*b* is provided in the inner peripheral surface of the roller main portion 44, and the cap part 45 includes the fitting recessed portion 50*b*, and the cam portion 50*a* that relatively guides the fitting pin 44*b* toward the fitting recessed portion 50*b*. As a result, the roller 41 with a relatively simple structure, facilitating its assembly work, can be fabricated.

In the present embodiment, a first cover member 14 for water passage formation, made of plastic is attached to the internal wall surface of the washing tub 5, and the roller unit 43 is attached to the attachment section 31 of the first cover member 14. According to this, unlike a structure in which the roller unit 43 is attached to the washing tub 5 (body section 15) made of metal, it is easy to work the first cover member 14 made of plastic into a desired shape. Therefore, it is possible to employ a relatively complicated shape (attachment structure) with a low cost.

In this case, in the attachment section 31 of the first cover member 14, the upper holding section 37 and the lower holding section 38 are provided to maintain the shaft 46 of the roller 41 in a state where the shaft is prevented from coming off by working together with the holding member 42. Accordingly, unlike the case where the shaft 46 is held by the holding member 42 alone, structure of the bearing portions 56 and 57 of the holding member 42 can be simplified. When being detached, the roller 41 is easily detached from the roller unit 43.

In addition, in the present embodiment, the roller 41 is formed in a hollow shape, and is provided with the opening 49 in its lower end face. Accordingly, even if washing liquid enters the inside of the roller 41, the washing liquid can be easily discharged through the opening 49, thereby preventing the washing liquid from accumulating inside the roller 41. It is obvious that the roller 41 itself can be manufactured in lightweight and at low cost. Then, the opening 49 of the roller 41 is disposed at a position away from the cylindrical portion 48 holding the shaft 46 as viewed from the axial direction. Thus, when the roller 41 (roller main portion 44) is formed of a plastic molding, the opening 49 is easily formed.

In the present embodiment, the side expanded portions 62 and 62 are further provided at positions in the corresponding both side portions across the roller 41 of the washing tub 5, and extend so as to form a smooth curve along the exposed outer periphery wall surface of the roller 41. This allows laundry to be smoothly guided toward the exposed outer periphery wall surface by the roller 41. In this case, the laundry can be smoothly moved without being choked or caught at a place of the roller 41.

Then, the side expanded portions 62 are formed in the holding member 42 and the first cover member 24, made of plastic. This enables the side expanded portions 62 to be easily provided with even a relatively complex shape while being formed at low cost. Then, handling such as attaching the roller 41 (roller unit 43) to the washing tub 5 and detaching it therefrom is also facilitated. In the present embodiment, each of the side expanded portions 62 is formed by continuously joining the holding-member-side curved wall 61 of the holding member 42 and the cover-side-curved wall 39 of the first cover member 24 to each other. Thus, the side expanded portions 62 can be provided within a wide range so as to form a smoother curve.

Particularly in the present embodiment, the holding-member-side curved wall 61 is formed such that its curvature as viewed from above changes near the roller 41. Accordingly, the side expanded portions 62 including a smooth curve can smoothly guide laundry toward the roller 41, and a shape suitable for preventing a cloth from being choked or caught can be applied to a portion near the roller 41. The upper expanded portion 63 is provided at a position above the roller 41, so that a cloth can be prevented from being choked or caught also in a portion above the roller 41. In addition, the lower expanded portion 64 is provided at a position below the roller 41, so that a cloth can be prevented from being choked or caught also in a portion below the roller 41.

In addition to the above, in the present embodiment, the first cover member 24 further serves not only to attach the roller 41 but also to form the water passage 23. Accordingly, simplification of the structure as well as space-saving can be achieved. Then, the roller 41 is provided in a form where the water passage 23 is separated. Accordingly, a design of the water passage 23 enables adjustment (setting) and the like of a direction of a water flow, a discharge position of water, and a flow rate in the water passage 23 to be facilitated. Unlike the case where the roller 41 is positioned in the water passage 23, lint is less likely to be caught or choked in the roller 41, so that a favorable flow in the water passage can be secured. In the present embodiment, the opening 31*a* provided in the first cover member 24 enables a gap between the roller 41 and an inner peripheral surface of the washing tub 5 to be secured, so that a placement space of the roller 41 can be reduced in a radial direction of the washing tub 5.

Between the first cover member 24 and the washing tub 5, the inner packing 34 is provided at a position surrounding an outer periphery of the opening 31*a*. This allows the water passage 23 to be provided in the outside of the opening 31*a*, so that the opening 31*a* is sealed by the surrounding inner packing 34 to enable leakage of washing water in the opening 31*a* to be prevented. The water passage 23 in the first cover member 24 is provided in each of the side portions across the roller 41, so that a large cross-sectional area of the water passage 23 (a flow rate of water) can be secured while the water passage 23 and the roller 41 are disposed in a relatively compact manner.

(2) Second and Third Embodiments

Figure 15:
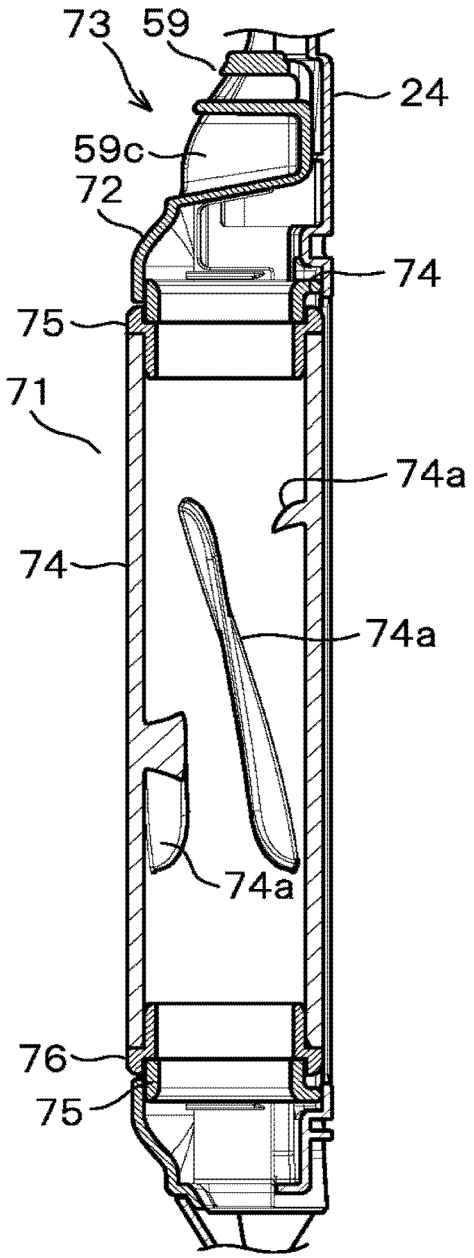
FIG. 15 is a longitudinal sectional view of a roller unit according to a second embodiment.

FIG. 15 illustrates a second embodiment. The second embodiment is different from the first embodiment described above in structure of a roller 71. This roller 71 is rotatably held by a holding member 72 to form a roller unit 73. In the roller 71, upper and lower cap parts 75 and 76 are attached to upper and lower ends of a roller main portion 74, respectively. The roller main portion 74 is formed in a cylindrical shape having open upper and lower end faces, and three ribs 74*a* are integrally provided in an inner peripheral surface portion of the roller main portion so as to extend in the vertical direction while being provided with propeller-like slight twist. The upper and lower cap parts 75 and 76 are each formed in a ring shape (thin cylindrical shape) fitted in an inner peripheral portion of the corresponding end of the roller main portion 74.

On the other hand, in the holding member 72, an upper bearing ring 77 and a lower bearing ring 78 are provided as a bearing portion for rotatably supporting the roller 71. The upper bearing ring 77 is formed in a ring shape, and is fitted in an inner periphery of the upper cap part 75 from above to be slidable on an inner peripheral surface of the upper cap part 75. In addition, the upper bearing ring 77 regulates upward displacement of the upper cap part 75. The lower bearing ring 78 is also formed in a ring shape, and is fitted in an inner periphery of the lower cap part 76 from below to be slidable on an inner peripheral surface of the lower cap part 76. In addition, downward displacement of the lower cap part 76 is regulated.

In this way, the roller 71 is rotatably supported by the holding member 72, and the roller unit 73 is detachably attached to the first cover member 24 of the inner wall portion on the washing tub 5 in this state. Thus, the roller 71 including no shaft 46 may be employed. It is possible to reduce the number of components and assembly man-hours, simplify the configuration, and reduce the weight.

Figure 16:
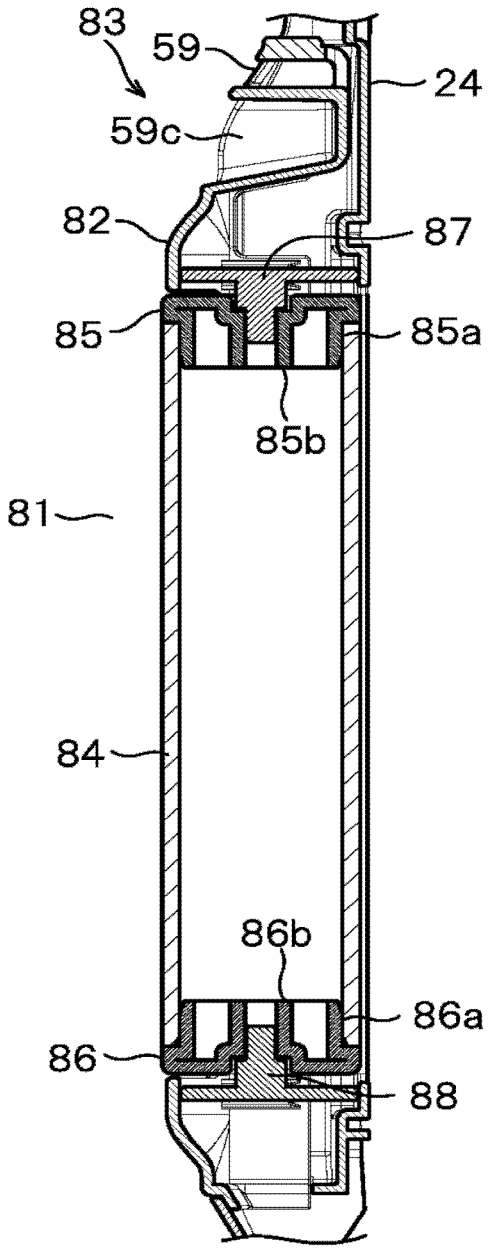
FIG. 16 is a longitudinal sectional view of a roller unit according to a third embodiment.

FIG. 16 illustrates a roller 81 according to a third embodiment, and the roller 81 is different from the rollers 41, 71 of the above first and second embodiments in the following point. In this case, the roller 81 is rotatably held by a holding member 82 to form a roller unit 83. That is, in the roller 81, upper and lower cap parts 85 and 86 are attached to upper and lower ends of a roller main portion 84 formed in a cylindrical shape having open upper and lower end faces, respectively.

The upper cap part 85 among these integrally has a fitting part 85*a* fitted in an upper inner periphery of the roller main portion 84, on a lower surface side of a disc part disposed on an upper end face of the roller main portion 84. In addition, the upper cap part 85 integrally has a cylindrical part 85*b* that is positioned at a central portion of the disc part, and vertically passes through the disc part to project downward. Additionally, the lower cap part 86 integrally has a fitting part 86*a* fitted in a lower inner periphery of the roller main portion 84, on an upper surface side of the disc part disposed on a lower end face of the roller main portion 84. In addition, the lower cap part 86 integrally has a cylindrical part 86*b* that is positioned at a central portion of the disc part, and vertically passes through the disc part to project upward.

An upper support shaft 87 and a lower support shaft 88 are provided as bearing portions for rotatably supporting the roller 81 in the holding member 82. The upper support shaft 87 is inserted into the cylindrical part 85*b* of the upper cap part 85 from above to be slidable on an inner peripheral surface of the cylindrical part 85*b* of the upper cap part 85. In addition, upward displacement of the upper cap part 85 is regulated. Similarly, the lower support shaft 88 is inserted into the cylindrical part 86*b* of the lower cap part 86 from below to be slidable on an inner peripheral surface of the cylindrical part 86*b* of the lower cap part 86. In addition, downward displacement of the lower cap part 85 is regulated.

In this way, the roller 81 is rotatably held by the holding member 82, and the roller unit 83 is detachably attached to the first cover member 24 of the inner wall portion on the washing tub 5 in this state. In this case, the roller 81 including no shaft 46 is employed, so that it is possible to reduce the number of components and assembly man-hours, simplify the configuration, and reduce the weight.

(3) Fourth and Fifth Embodiments, and Other Embodiments

Figure 17A:
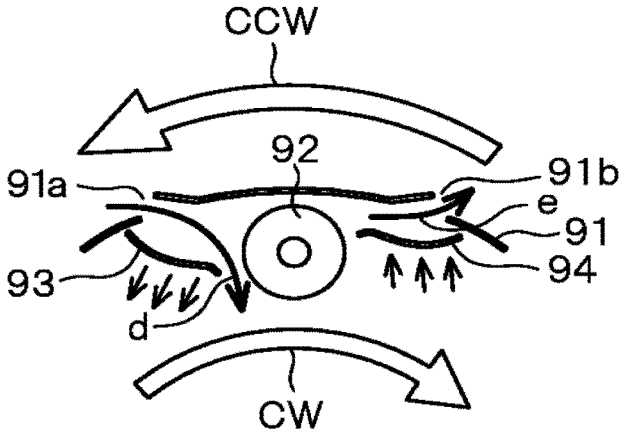
FIG. 17A is a cross sectional top view schematically illustrating a mode of a roller and side expanded portions according to a fourth embodiment.
Figure 17B:
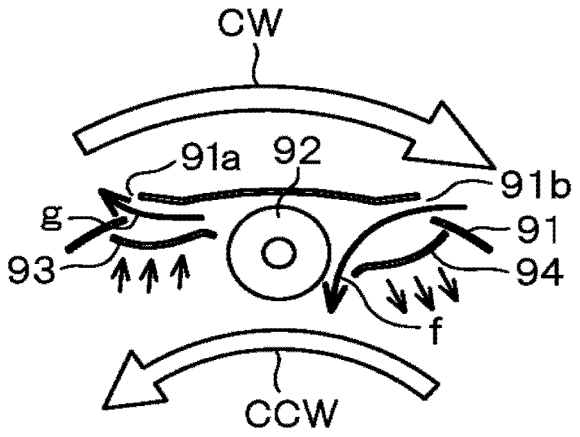
FIG. 17B is a cross sectional top view schematically illustrating a different mode of the roller and the side expanded portions according to the fourth embodiment.

FIGS. 17A and 17B illustrate a fourth embodiment, and the fourth embodiment is different from the above first embodiment in the following. That is, in an inner peripheral wall portion of a washing tub 91, a roller 92 is rotatably provided such that the central axis is positioned on an inner periphery side of the washing tub 91. In an inner peripheral wall portion of the washing tub 91, side expanded portions 93 and 94 are provided at positions in the corresponding both left and right side portions in the drawing across the roller 92, and extend so as to form a smooth curve along the exposed outer periphery wall surface of the roller 92, and the side expanded portions 93 and 94 serving to smoothly guide laundry toward the roller 92.

These side expanded portions 93 and 94 are each formed in the shape of a thin plate curved so as to smoothly expand to the inner periphery side, as viewed from above. The side expanded portion 93 on the left in the drawing among these is supported by a hinge in an edge portion on a base end side (left end side in the drawing), and is rotationally (rockingly) displaceable around a vertical shaft between a pushed-out position illustrated in FIG. 17A and a retracted position illustrated in FIG. 17B. At the pushed-out position of the side expanded portion 93, a leading edge portion side positioned on a left side portion of the roller 92 comes on the inner periphery side of the washing tub 91 with respect to the central axis of the roller 92. At the retracted position of the side expanded portion 93, the leading edge portion side comes on an outer periphery side with respect to the central axis of the roller 92.

Similarly, the side expanded portion 94 on the right in the drawing is supported by a hinge in an edge portion on a base end side (right end side in the drawing), and is rotationally (rockingly) displaceable around a vertical shaft between a pushed-out position illustrated in FIG. 17B and a retracted position illustrated in FIG. 17A. In a wall portion of the washing tub 91, a left water passing hole 91*a* is formed so as to be positioned on a back face side near the base end side of the side expanded portion 93. In addition, a right water passing hole 91*b* is formed so as to be positioned on a back face side near the base end side of the side expanded portion 94. These left water passing hole 91*a* and right water passing hole 91*b* suck or discharge washing water from a space between an outer peripheral surface of the washing tub 91 and a water tank (not illustrated) in accordance with the rotational direction, with rotation of the washing tub 91.

In the above configuration, as illustrated in FIG. 17A, when the washing tub 91 rotates counterclockwise (in a direction of an arrow "CCW") as viewed from above, washing water is sucked from the left water passing hole 91*a* to the inside, as illustrated by an arrow "d". Then, the side expanded portion 93 on the left side is displaced to the pushed-out position by the water pressure. Additionally, as illustrated by an arrow "e", washing water is discharged from the right water passing hole 91*b* to the outside, the back face side of the side expanded portion 94 on the right side becomes negative pressure, and the side expanded portion 94 is displaced to the retracted position. In this state, rotating water flow occurs relatively clockwise (in a direction of an arrow "CW") in the washing tub 91, and moves laundry in a direction of an arrow "CW". In this way, the laundry can be smoothly guided to the roller 92 portion by the side expanded portion 93 on the left positioned at the pushed-out position.

On the other hand, as illustrated in FIG. 17B, when the washing tub 91 rotates clockwise (in a direction of an arrow "CW") as viewed from above, washing water is sucked from the right water passing hole 91*b* to the inside, as illustrated by an arrow "f". Then, the side expanded portion 94 on the right side is displaced to the pushed-out position by the water pressure. Additionally, as illustrated by an arrow "g", washing water is discharged from the left water passing hole 91*a* to the outside, the back face side of the side expanded portion 93 on the left side becomes negative pressure, and the side expanded portion 93 is displaced to the retracted position. In this state, rotating water flow occurs relatively counterclockwise (in a direction of an arrow "CCW") in the washing tub 91, and moves laundry in a direction of an arrow "CCW". In this way, the laundry can be smoothly guided to the roller 92 portion by the side expanded portion 94 on the right positioned at the pushed-out position.

According to such a fourth embodiment, the side expanded portions 93 and 94 on an upstream side in the direction of the rotating water flow is positioned at the pushed-out position, and therefore the laundry can be smoothly moved toward an outer periphery wall surface of the roller 92. Additionally, on a downstream side of the rotating water flow, the side expanded portions 93 and 94 come to the retracted position, and therefore a space (capacity) in the washing tub 5 can be prevented from being narrowed uselessly. The positions of the side expanded portions 93 and 94 can be displaced by water flow (water pressure), and a special mechanism such as a driving source for positional displacement of the side expanded portions 93 and 94 do not need to be provided.

Figure 18:
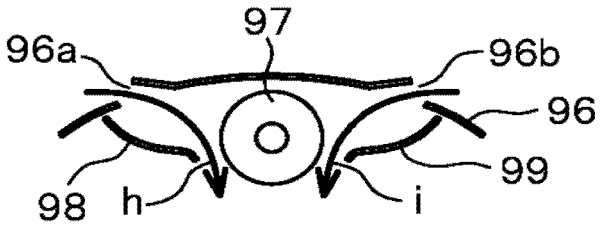
FIG. 18 is a cross sectional top view schematically illustrating a roller and side expanded portions according to a fifth embodiment.

FIG. 18 illustrates a fifth embodiment, and the fifth embodiment is different from the above fourth embodiment in the following point. That is, in the present embodiment, in an inner peripheral wall portion of a washing tub 96, a roller 97 is rotatably provided such that the central axis is positioned on an inner periphery side of the washing tub 96. In an inner peripheral wall portion of the washing tub 96, side expanded portions 98 and 99 are provided at positions in the corresponding both left and right side portions in the drawing across the roller 97, and extend so as to form a smooth curve along an exposed outer periphery wall surface of the roller 97, and the side expanded portions 98 and 99 serving to smoothly guide laundry toward the roller 97.

These side expanded portions 98 and 99 are each formed in the shape of a thin plate curved so as to smoothly expand to the inner periphery side as viewed from above, and are fixedly provided in the washing tub 96. At this case, leading end portions of the side expanded portions 98 and 99 are provided in a form of having gaps with the roller 97. In a wall portion of the washing tub 96, water passing holes 96*a*, 96*b* for sucking washing water to the inside from a space between an outer peripheral surface of the washing tub 96 and a water tank (not illustrated) are formed so as to be positioned on a back face side near the base end sides of the side expanded portions 98 and 99.

In this configuration, as illustrated by an arrow "h" and an arrow "i" in the drawing, washing liquid between the washing tub 96 and the water tank is sucked from the water passing holes 96*a* and 96*b* to the back face sides of the side expanded portions 98 and 99 by rotation of the washing tub 96. Then, water flow that flows into the washing tub 96 through the gaps between the roller 97 and the side expanded portions 98 and 99 is generated. Accordingly, according to the present embodiment, laundry can be smoothly moved toward an outer periphery wall surface of the roller 97 by the side expanded portions 98 and 99. In addition, laundry can be effectively prevented from being caught in the gaps between the roller 97 and the side expanded portions 98 and 99.

Various modifications are considered for the configuration of the roller like the roller 71 and 81 of the above second and third embodiments. For example, a shaft portion may be integrally provided in an end face portion instead of proving a shaft, and an outer peripheral surface of a roller may be formed in a tapered surface shape such that an outer diameter of the roller decreases downward from an upper end. Various modifications are also available for the shape or the structure of the side expanded portion. For example, the side expanded portion may be provided only in a holding member, or may be provided only in a cover member. In addition, various modifications are also available for structure of a holding member that holds a roller. While a roller is rotatably held in a holding member constituting a roller unit in each of the embodiments described above, an axially supporting portion may be provided on a washing tub side to rotatably support a roller. Accordingly, the number of components also can be reduced as compared with a case of unitization, so that a simple and inexpensive structure can be formed.

Since the embodiments described above are presented as examples, there is no intention to limit the scope of the invention. The embodiments described above can be practiced in various other aspects, and thus various omissions, replacements, and modifications may be made within a range without departing from the essence of the invention. The present embodiments and their variations are included in the scope and essence of the invention as well as in a range equal to that of the invention described in claims.

The invention claimed is:

1. A washing machine comprising:

a washing tub in which laundry is housed and washed; and a roller rotatably provided in an inner wall portion of the washing tub, and the roller being rotated to facilitate movement of laundry, a holding member for rotatablv supporting the roller in a state where an outer periphery wall surface of the roller is partially exposed, wherein the roller is detachably attached to the washing tub from an inner periphery side of the washing tub, and an end face of the roller has a rib for preventing a cloth from being caught provided on an outer periphery side so as to block a gap between the roller and the holding member.

2. The washing machine according to claim 1 wherein the roller is supported by an axially supporting portion provided on a side wall portion side of the washing tub.

3. The washing machine according to claim 1, wherein the roller is held by the holding member to form a roller unit, the roller unit is detachably attached to the washing tub from an inner periphery side of the washing tub, and the holding member includes a knob portion that is used to be gripped by fingers of a hand when the roller unit is attached or detached.

4. The washing machine according to claim 3, wherein the holding member includes a bearing portion that axially supports the roller.

5. The washing machine according to claim 3, wherein the rib is provided on the end face on an upper side of the roller, the holding member includes a rectangular opening exposing a part of an outer peripheral surface of the roller, and an upper wall portion allowing the rib to be disposed is integrally provided in an upper end portion of the rectangular opening on a back face (inner surface) side of the holding member, and the rib is provided up to a position higher than the lower part of the upper wall portion.

6. The washing machine according to claim 3, wherein the rib provided on the end face of the roller is configured to serve as a wrong-assembly preventing member that allows the roller to be held when being placed in a correct direction with respect to the holding member, but that does not allow the roller to be held when being placed in an incorrect direction.

7. The washing machine according to claim 3, wherein a cover member for water passage formation, made of plastic is attached to an internal wall surface of the washing tub, and the roller unit is attached to an attachment section of the cover member.

8. The washing machine according to claim 7, wherein in the attachment section of the cover member, a holding section is provided to maintain a shaft of the roller in a state where the shaft is prevented from coming off by working together with the holding member.

9. The washing machine according to claim 1, wherein the roller has a cylindrical portion positioned at a shaft center portion and holding a shaft, and the opening is disposed at a position away from the cylindrical portion as viewed from an axial direction.

10. A washing machine comprising:

a washing tub in which laundry is housed and washed; and a roller rotatable provided in an inner wall portion of the washing tub, and the roller being rotated to facilitate movement of laundry, wherein the roller is detachably attached to the washing tub from an inner periphery side of the washing tub, and side expanded portions that are positioned at corresponding both side portions across the roller of the washing tub, that extend so as to form a smooth curve along an exposed outer periphery wall surface of the roller, and that smoothly guide laundry toward the roller are provided, the roller is held by a holding member to form a roller unit, the roller unit is attached to a cover member made of plastic provided in an internal wall surface of the washing tub, and each of the side expanded portions is formed by continuously joining a curved wall provided in the holding member, and a curved wall provided in the cover member.

11. The washing machine according to claim 10, wherein in the curved wall provided in the holding member, curvature as viewed from above changes near the roller.

12. The washing machine according claim 10, wherein the side expanded portions are each configured to be displaceable between a pushed-out position where a leading edge portion side positioned at a side portion of the roller comes on an inner peripheral side of the washing tub with respect to a central axis of the roller and a retracted position where the leading edge portion side comes on an outer peripheral side with respect to the central axis of the roller, and displaces positions in accordance with a direction of rotating water flow of washing liquid generated in the washing tub.

13. The washing machine according to claim 10, wherein washing liquid in the washing tub flows into the washing tub from sides of back faces of the side expanded portions through gaps between the roller and the side expanded portions.

* * * * *